US005511045A

United States Patent [19]

Sasaki et al.

[11] Patent Number: 5,511,045

[45] Date of Patent: Apr. 23, 1996

[54] TIME MEASUREMENT APPARATUS AND SYSTEM HAVING RECEPTION OR TRANSMISSION FUNCTION

[75] Inventors: Ken Sasaki; Hideyuki Shoji; Yoshiyuki Murata, all of Tokyo, Japan

[73] Assignee: Casio Computer Co., Ltd., Tokyo, Japan

[21] Appl. No.: 990,916

[22] Filed: Dec. 15, 1992

[30] Foreign Application Priority Data

Dec. 19, 1991 [JP] Japan ..... 3-354909
Dec. 27, 1991 [JP] Japan ..... 3-360753

[51] Int. Cl.[6] ..... G04F 8/00; G04B 47/00; G08B 23/00

[52] U.S. Cl. ..... 368/2; 368/10; 368/113; 340/323 R; 340/ 539; 364/569

[58] Field of Search ..... 368/10, 11, 107, 368/113, 2, 3, 9; 340/323 R; 364/569; 377/20, 24, 24.2; 235/377, 380, 382, 384, 385

[56] References Cited

U.S. PATENT DOCUMENTS 3,714,649 1/1973 Brouwer et al. .
4,074,117 2/1978 Delorean et al. .
4,823,367 4/1989 Kreutzfeld ..... 377/24.2
5,140,307 8/1992 Rebetez et al. ..... 340/539
5,241,487 8/1993 Bianco ..... 364/569
5,245,162 9/1993 Takahashi ..... 235/377

FOREIGN PATENT DOCUMENTS 2-200280 8/1990 Japan .
4-86593 3/1992 Japan .
4-86592 3/1992 Japan .

*Primary Examiner*—Vit W. Miska
*Attorney, Agent, or Firm*—Frishauf, Holtz, Goodman, Langer & Chick

[57] ABSTRACT

An apparatus designed to automatically measure the total moving time, split times, time lag, and the like of each of a plurality of moving objects, and determine the arriving order of each moving object. Every time a plurality of moving objects, e.g., runners or vehicles, pass through each predetermined point, pieces of information such as total running/moving times, split times, time lags, and arriving orders are transmitted, in units of moving objects, to the respective moving objects or a transmission/reception unit arranged at each predetermined point. When moving objects pass through a predetermined point, and their moving times exceed passage times set in units of moving objects, an excess time is informed to each moving object.

46 Claims, 15 Drawing Sheets

FIG.3

| ADDRESS | CONTENTS |
|---|---|
| 100 | START TIME INFORMATION SK |
| 200 | DISQUALIFICATION NOTIFICATION SET TIME INFORMATION STS |
| 300 | DISQUALIFICATION INFORMATION CHT |
| 301 | EXCESS TIME INFORMATION CHO |

| | ADDRESS | CONTENTS |
|---|---|---|
| RUNNER A | 1000 | START POINT PASSAGE TIME INFORMATION TZ |
| RUNNER B | 1001 | 10-km POINT PASSAGE TIME INFORMATION TZ |
| | 1002 | 20-km POINT PASSAGE TIME INFORMATION TZ |
| RUNNER C | 1003 | 30-km POINT PASSAGE TIME INFORMATION TZ |
| | 1004 | 40-km POINT PASSAGE TIME INFORMATION TZ |
| RUNNER D | 1005 | FINISH POINT PASSAGE TIME INFORMATION TZ |
| | 1006 | TIME LAG INFORMATION TR |
| RUNNER E | 1007 | TOTAL RUNNING TIME INFORMATION BETWEEN START AND 10-km POINTS TT |
| | 1008 | TOTAL RUNNING TIME INFORMATION BETWEEN START AND 20-km POINTS TT |
| | | |
| | 1020 | OFFICIAL 10-km POINT PASSAGE TINE INFORMATION KZA |
| | 1021 | OFFICIAL 20-km POINT PASSAGE TINE INFORMATION KZA |
| | | |
| RUNNER N | 1030 | SPLIT TIME INFORMATION BETWEEN 10- AND 20-km POINTS ST |
| | 1031 | SPLIT TIME INFORMATION BETWEEN 20- AND 30-km POINTS ST |
| | | |
| | 1040 | ARRIVING ORDER INFORMATION AT 10-km POINT TJ |
| | 1041 | ARRIVING ORDER INFORMATION AT 20-km POINT TJ |
| | | |
| | 1050 | OFFICIAL ARRIVING ORDER INFORMATION AT 10-km POINT KT |
| | 1051 | OFFICIAL ARRIVING ORDER INFORMATION AT 20-km POINT KT |
| | | |
| | 1060 | ARRIVING ORDER INFORMATION BETWEEN 10- AND 20-km POINTS TJ |
| | 1061 | ARRIVING ORDER INFORMATION BETWEEN 20- AND 30-km POINTS TJ |
| | ⋮ | ⋮ |
| | 2000 | START POINT PASSAGE TIME INFORMATION TZ |
| | 2001 | 10-km POINT PASSAGE TIME INFORMATION TZ |
| | ⋮ | ⋮ |
| | 3000 | START POINT PASSAGE TIME INFORMATION TZ |
| | 3001 | 10-km POINT PASSAGE TIME INFORMATION TZ |

FIG. 12
| A | B | INSTRUSTION |
|---|---|---|
| 0 | 0 | N.F. |
| 1 | 0 | START |
| 1 | 1 | SP/LAP |
| 0 | 1 | STOP |
FIG. 13
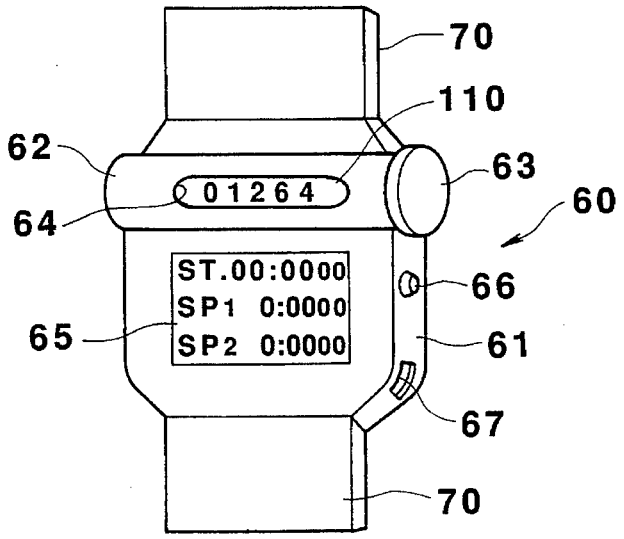
FIG. 16
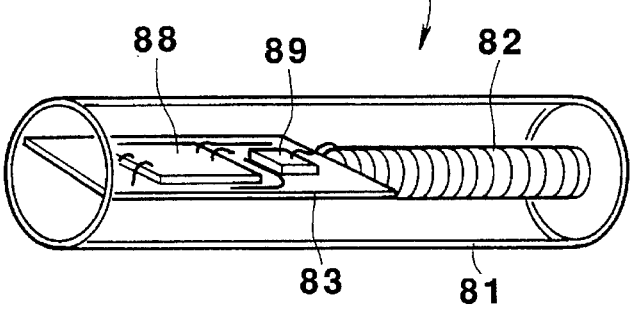

FIG. 15

| ADDRESS | CONTENTS |
|---|---|
| 200 | DISQUALIFICATION NOTIFICATION SET TIME INFORMATION STS |
| 300 | DISQUALIFICATION INFORMATION CHT |
| 301 | EXCESS TIME INFORMATION CHO |

ID CODE OF RUNNER A

| ADDRESS | CONTENTS |
|---|---|
| 1006 | TIME LAG INFORMATION TR |
| 1007 | TOTAL RUNNING TIME INFORMATION BETWEEN START AND 10-km POINTS TT |
| 1008 | TOTAL RUNNING TIME INFORMATION BETWEEN START AND 20-km POINTS TT |
| | |
| 1020 | OFFICIAL 10-km POINT ELAPSED TINE INFORMATION KZ |
| 1021 | OFFICIAL 20-km POINT ELAPSED TINE INFORMATION KZ |
| | |
| 1030 | SPLIT TIME INFORMATION BETWEEN 10- AND 20-km POINTS ST |
| 1031 | SPLIT TIME INFORMATION BETWEEN 20- AND 30-km POINTS ST |
| | |
| 1040 | ARRIVING ORDER INFORMATION AT 10-km POINT TJ |
| 1041 | ARRIVING ORDER INFORMATION AT 20-km POINT TJ |
| | |
| 1050 | OFFICIAL ARRIVING ORDER INFORMATION AT 10-km POINT KT |
| 1051 | OFFICIAL ARRIVING ORDER INFORMATION AT 20-km POINT KT |
| | |
| 1060 | ARRIVING ORDER INFORMATION BETWEEN 10- AND 20-km POINTS TJ |
| 1061 | ARRIVING ORDER INFORMATION BETWEEN 20- AND 30-km POINTS TJ |
| ⋮ | ⋮ |
| 2006 | TIME LAG INFORMATION TR |
| 2007 | TOTAL RUNNING TIME INFORMATION BETWEEN START AND 10-km POINTS TT |
| 2008 | TOTAL RUNNING TIME INFORMATION BETWEEN START AND 20-km POINTS TT |
| ⋮ | ⋮ |
| 3006 | TIME LAG INFORMATION TR |
| 3007 | TOTAL RUNNING TIME INFORMATION BETWEEN START AND 10-km POINTS TT |
| 3008 | TOTAL RUNNING TIME INFORMATION BETWEEN START AND 20-km POINTS TT |

TIME MEASUREMENT APPARATUS AND SYSTEM HAVING RECEPTION OR TRANSMISSION FUNCTION

BACKGROUND OF THE INVENTION

1. Field of the Invention

The present invention relates to a time measurement apparatus and a time measurement system having a reception or transmission function and, more particularly, to a time measurement apparatus and a time measurement system capable of e.g., performing time measurement such as measurement of the moving time of each of a plurality of moving objects, and determining the arriving order of each moving object.

2. Description of the Related Art

Time measurement apparatuses have been used for various types of time measurement. For example, in a short- or middle-distance race, in which the number of runners is relatively small, or in a marathon race, in which a large number of runners participate, the time measurement apparatuses are used to measure the total running time of each runner from a start line to a finish line and the split time of each runner in each predetermined interval. The apparatuses are also used to measure the time required for a target object (to be checked) or a moving object such as a vehicle to move through a predetermined interval.

Conventional time measurement apparatuses used in running races operate in the following manner. In a short- or middle-distance race, in which the number of runners is relatively small, in order to measure the total running time of each runner from a start line to a finish line and determine the arriving order of each runner, for example, the runners themselves or a relatively small number of judges selected by the sponsor of the competition start a time measurement operation of the time measurement apparatuses by operating the start switches at the start line, and stop the operation by operating the stop switches at the finish line. However, in a marathon race, in which a large number of runners participate, it is very difficult to measure the total running time of each runner or the split time in each predetermined interval, or to determine the arriving order of each runner. Especially when a group of a large number of runners reach the finish line, it is difficult to measure the total running time of each runner or the split time of each runner, or to determine the arriving order of each runner with high accuracy. For this reason, in recent marathon races, in which a large number of runners participate, a video camera or a bar code reader are used to read racing numbers, bar codes, or the like, attached to the respective runners in advance, at the finish line or a predetermined point, thereby measuring the total running time of each runner or the split time of each runner, or determining the arriving order of each runner.

However, in the method of using a video camera or a bar code reader to perform a reading operation so as to measure the total running time or split time of each runner or determine the arriving order of each runner, racing numbers or bar codes attached to runners who are running must be accurately read by using a video camera or a bar code reader. For this purpose, an expensive, high-precision reader unit is required.

In addition, runners themselves want to know their split times, arriving orders, and the like in each predetermined interval during or after the race. It is, however, difficult for each runner to know the total time, the split time in each predetermined interval, and the arriving order during or after the race by using the conventional time measurement apparatus.

SUMMARY OF THE INVENTION

The present invention has been made to solve such conventional problems.

It is, therefore, an object of the present invention to provide an apparatus which can accurately, easily, and automatically measure the total moving times, split times, time lags, and the like of a plurality of moving objects, determine the arriving order of the respective moving objects, and inform of disqualification or the like without requiring a large number of men and much time.

It is another object of the present invention to provide an apparatus which can obtain pieces of external information by only attaching a plurality of detachable members to moving objects.

According to an aspect of the present invention, there is provided an apparatus comprising identification information receiving means, respectively arranged at a plurality of points through which a plurality of moving objects, each of which independently transmits moving object identification information, sequentially pass, for receiving pieces of moving object identification information respectively transmitted from the moving objects every time the moving objects pass through the respective points, and information output means for, every time the pieces of moving object identification information are received by the identification information receiving means in a unit of moving objects, sequentially outputting the received pieces of moving object identification information and pieces of reception time point information indicating time points at which the pieces of moving object identification information are received.

In this case, the plurality of moving objects broadly mean portable information devices, e.g., wristwatches, and accessories, e.g., clothes, shoes, hats, and jewels, which are attached to men who run a marathon race or walk, and animals, and objects which are mainly designed to move, such as vehicles and ships. For example, the pieces of moving object identification information are ID codes respectively assigned to the plurality of moving objects. In addition, the information output means is a display means for visually outputting the pieces of reception time point information and moving object identification information or a printing means for printing them.

With this arrangement, when a plurality of moving objects move, pieces of reception time point information about the respective moving objects can be quickly and easily output, e.g., in the form of print-out or display, in units of moving objects without the mediacy of men.

According to another aspect of the present invention, there is provided an apparatus comprising a moving object, and a detachable member detachably mounted on the moving object, the detachable member including reception means for receiving a transmission signal transmitted externally, and information output means for outputting reception time point information in response to a transmission signal received by the reception means, the reception time point information indicating a reception time point at which the transmission signal is received.

In this case, the moving object broadly means portable information device, e.g., wristwatch, and accessory, e.g., cloth, shoe, hat, and jewel, which is attached to men who run a marathon race or walk, and animal, and object which is mainly designed to move, such as vehicle and ship.

With this arrangement, by only attaching detachable member to moving object as needed, piece of reception time information at reception time point can be quickly and easily obtained.

According to still another aspect of the present invention, there is provided an apparatus comprising a moving object, and a detachable member detachably mounted on the moving object, the detachable member including reception means for receiving moving object identification information transmitted externally, matching determination means for determining whether the moving object identification information received by the reception means matches with self-identification information, and information output means for outputting reception time point information indicating a reception time point at which the moving object identification information is received, when the matching determination means determines that the received moving object identification information matches with the self-identification information.

With this arrangement, by only attaching detachable member to moving object as needed, piece of reception time point information at reception time point at which piece of moving object identification information is received can be quickly and easily obtained.

According to still another aspect of the present invention, there is provided an apparatus comprising a moving object, and a detachable member detachably mounted on the moving object, the detachable member including reception means for receiving externally transmitted moving object identification information and movement-associated information associated with a moving state of the moving object, matching determination means for determining whether the moving object identification information received by the reception means matches with self-identification information, and information output means for outputting reception time point information indicating a reception time point at which the moving object identification information is received, and the movement-associated information, when the matching determination means determines that the received moving object identification information matches with the self-identification information.

With this arrangement, by only attaching detachable member to moving object as needed, piece of reception time point information and movement-associated information at reception time point at which piece of moving object identification information is received can be quickly and easily obtained, and output, e.g., print or display, them.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3 is a view showing the storage state of a RAM in a time measurement apparatus in FIG. 1;

FIG. 12 is a view showing instructions communicated between the electronic wristwatch and the reader unit in FIG. 11;

FIG. 13 is a perspective view of the electronic wristwatch in FIG. 7 in a state wherein various kinds of information are displayed;

FIG. 15 is a view showing the storage state of a memory in the second embodiment of the present invention;

FIG. 16 is a perspective view of an ID code tag in the third embodiment of the present invention;

DETAILED DESCRIPTION OF THE PREFERRED EMBODIMENTS

Embodiments of the present invention will be described in detail below.

First Embodiment

Figure 1:
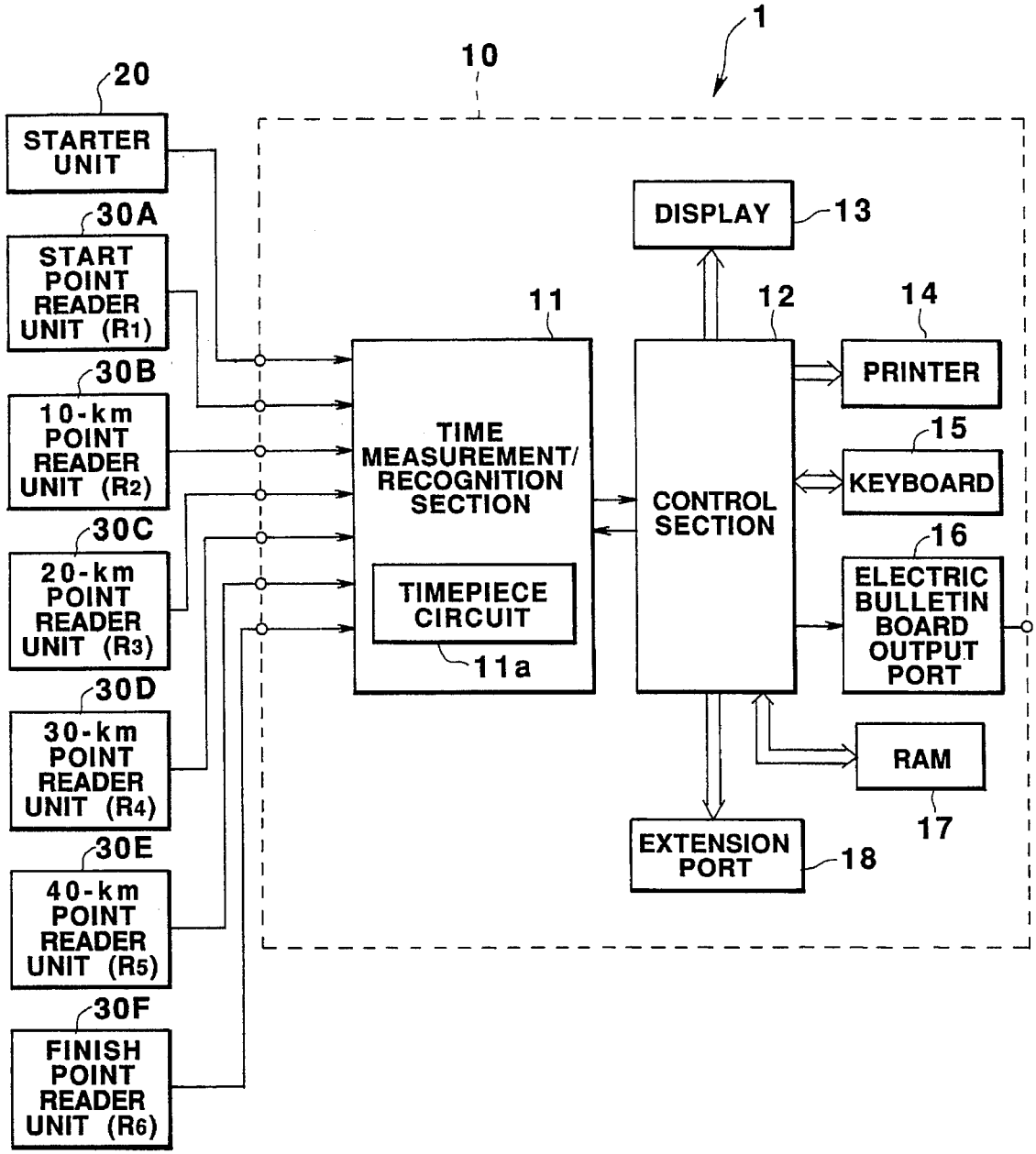
FIG. 1 is a block diagram showing the arrangement of a time measurement system according to the first embodiment of the present invention.
Figure 2:
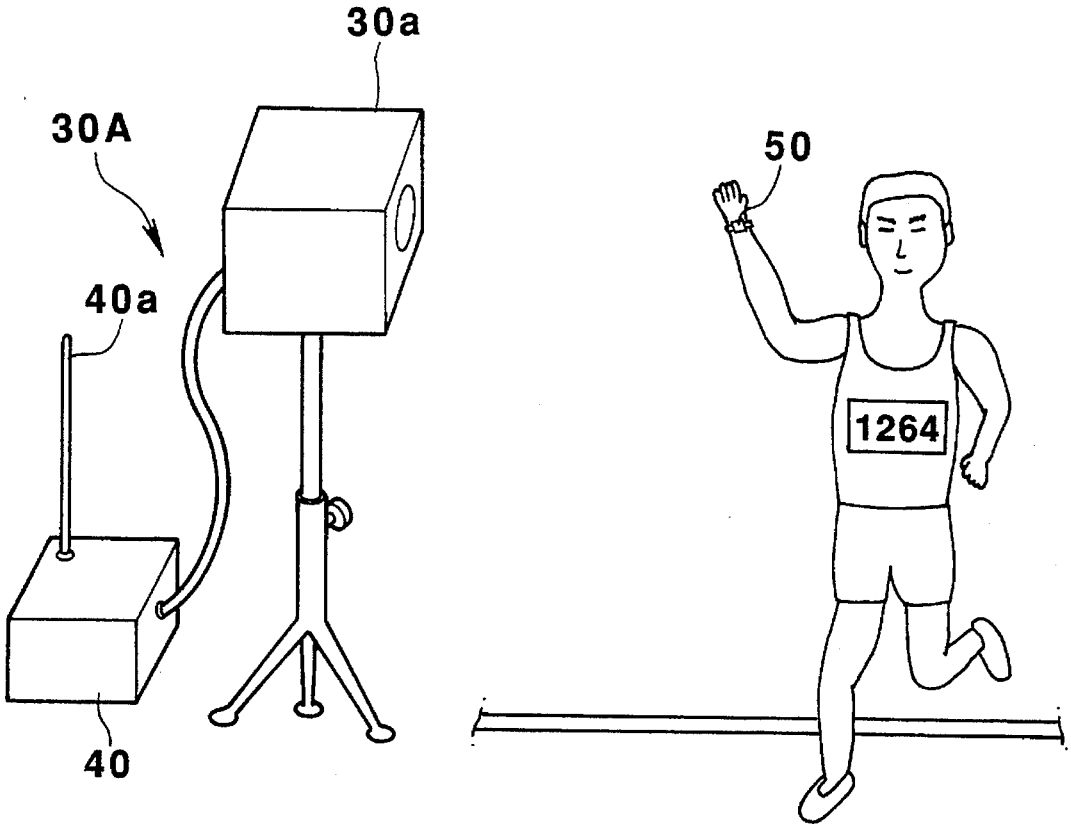
FIG. 2 is a view showing an example of how a reader unit is installed.

FIGS. 1 to 3 show the first embodiment in which the present invention is applied to time measurement, e.g., measurement of total times and split times, in a marathon race.

FIG. 1 is a block diagram showing the arrangement of a time measurement system including a time measurement apparatus 1.

The time measurement apparatus 1 comprises a time measurement/recognition processing unit 10, a starter unit 20, a plurality of reader units 30A to 30F, and the like.

The time measurement/recognition processing unit 10 comprises a time measurement/recognition section 11, a control section 12, a display 13, a printer 14, a keyboard 15, an electric bulletin board output port 16, a RAM (Random Access Memory) 17, an extension port 18, and the like. The time measurement/recognition section 11 receives electrical signals by receiving radio signals from the starter unit 20 and the respective reader units 30A to 30F.

The starter unit 20 includes, for example, a starting pistol and is designed to output a start signal to the time measurement/recognition section 11 at the same time when the pistol is operated to generate a starting sound.

The reader units 30A to 30F are respectively installed at a start point, a 10-km point, a 20-km point, a 30-km point, a 40-km point, and a finish point. The reader units 30A to 30F detect electromagnetic energies emitted from ID code units 50 respectively attached to the runners who pass through the respective points, and output corresponding detection signals to the time measurement/recognition section 11.

The reader units 30A to 30F have the same arrangement. FIG. 2 shows the reader unit 30A. Each of the reader units 30A to 30F is constituted by a reader main body 30*a* and a transmitter 40. A detection signal is transmitted from an antenna 40*a* of the transmitter 40 to the time measurement/recognition section 11. Note that the reader units 30A to 30F and the time measurement/recognition section 11 may be connected to each other through wires.

Reader numbers R1 to R6 are respectively assigned to the reader units 30A to 30F. For example, the reader numbers R1 to R6 are sequentially assigned to the reader units from the reader unit 30A at the start point to the reader unit 30F at the finish point. When detection signals are transmitted from the reader units 30A to 30F to the time measurement/recognition section 11, the reader numbers R1 to R6 assigned to the respective reader units are simultaneously transmitted to the time measurement/recognition section 11.

The time measurement/recognition section 11 has a time measurement function of measuring the total running time, elapsed time at each point, split times, and the like of each runner who participates in a marathon race, and manages the respective time measurement results in correspondence with preset ID codes (to be described later). More specifically, the time measurement/recognition section 11 has a timepiece circuit 11*a* for obtaining the current time by counting reference signals. Upon reception of a starting signal from the starter unit 20, the section 11 transmits current time data, obtained by the timepiece circuit 11*a* at that moment, to the control section 12. Upon reception of a detection signal from each of the reader units 30A to 30F, the section 11 recognizes the ID code (to be described later) of each runner who passes through a corresponding point, and outputs the recognized ID code of each runner, time information obtained at the time point at which each runner passes through the point, a corresponding reader number, and the like to the control section 12.

The control section 12 is constituted by a CPU (Central Processing Unit). The control section 12 stores current time information in the RAM 17, which information is simultaneously transmitted together with ID codes and each reader number, input from the time measurement/recognition section 11, in correspondence therewith. In addition, the control section 12 measures the split times, total running time, time lag, official total running time, and the like of each runner, and determines the arriving order, disqualification, and the like of each runner.

As shown in FIG. 3, the storage area of the RAM 17 has a first area which stores start time information SK, disqualification notification set tie information STS, disqualification information CHT based on elapsed time, and excess time information CHO, each output from the measurement/recognition section 11, and a second area which stores all kinds of time information in units of runners, i.e., ID codes respectively assigned to the ID code units 50 handed to the respective runners, as will be described later. In the second area, in units of ID codes, the following pieces of information are stored: start point passage time information TZ, 10-km point passage time information TZ, 20-km point passage time information TZ, 30-km point passage time information TZ, 40-km point passage time information TZ, finish point passage time information TZ, time lag information TR, total running time information TT between the start and 10-km points, total running time information TT between the start and 20-km points, split time information ST between the start and 10-km points, official 10-km point passage time information KZA, official 20-km point passage time information KZA, split time information ST between the 10-and 20-km points, split time information ST between the 20- and 30-km points, split time information ST between the 30- and 40-km points, split time information ST between the 40-km and finish points, arriving order information TJ at the 10-km point, arriving order information TJ at the 20-km point, arriving order information TJ at the 30-km point, arriving order information TJ at the 40-km point, arriving order information TJ between the start and 10-km points, arriving order information TJ between the 10- and 20-km points, arriving order information TJ between the 20- and 30-km points, arriving order information between the 30- and 40-km points, and arriving order information TJ between the 40- and finish points. Through it is not shown in FIG. 3, the second area further stores, in units of ID codes, official total running time information KT, arriving order information based on official or non-official time lag information, and the like.

Note that the disqualification notification set time information STS stored in the RAM 17 in advance is used to notify disqualification to a runner when he/she exceeds the set time. The runner who receives this notification is disqualified.

The display 13 serves to display a processing result obtained by the control section 12, various data and commands input from the keyboard 15, and the like.

The keyboard 15 is used to input commands indicating processing contents to be processed and various data, especially the racing numbers and registration numbers of the respective runners, to the control section 12.

The printer 14 serves to record a processing result obtained by the control section 12 or various data, especially the total running times and split times of the respective runners on a recording paper sheet.

An electric bulletin board (not shown) is directly connected to the electric bulletin board output port 16. Alternatively, a transmitter for transmitting data to the electric bulletin board is connected to the port 16. The control section 12 outputs time measurement data, e.g., time lags between start times and times at the start point, elapsed times between the start times and the current times, the split time of the leading runner at each point, and the like, through the electric bulletin board output port 16, thereby causing the electric bulletin board to display the data.

An external storage unit, e.g., a floppy disk unit or a hard disk unit, another display, another printer, or the like is connected to the extension port 18. The extension port 18 is used to input/output various data such as time measurement data. Note that the manner of using the extension port 18 is not limited to the one described above.

Figure 4:
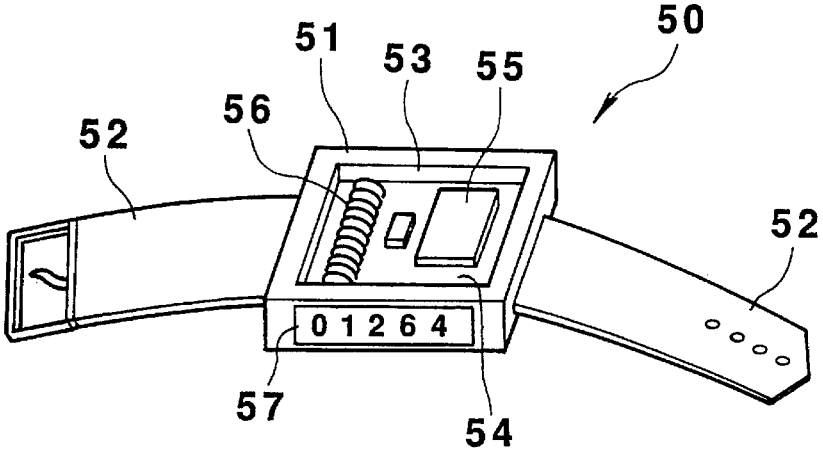
FIG. 4 is a perspective view of an ID code unit.

On the other hand, the ID code unit 50 shown in FIG. 4 is attached to each runner. The ID code unit 50 is constituted by a case 51, a band 52 fixed to the case 51, and the like. The ID code unit 50 is worn on the wrist of each runner through the band 52. The surface of the case 51 is covered with a glass 53 to protect the interior of the case 51. An IC board 54 is stored in the case 51. An LSI (Large Scale Integrated Circuit) 55, various circuit components, an antenna 56, and the like are mounted on the IC board 54. The LSI 55 contains a program for converting an ID code (identification information for identifying an ID code unit 50) such as a racing number or a registration number into a predetermined electromagnetic energy, and emitting the energy. That is, the LSI 55 serves to convert an ID code into an electromagnetic energy and emit it from the antenna 56 to each of the reader units 30A to 30F. Such an electromagnetic energy containing the ID code of the ID code unit 50 may be emitted by other methods than that used in this embodiment. In one method, a battery is incorporated in the ID code unit 50 so that when the ID code unit 50 detects a predetermined detection signal from one of the reader units 30A to 30F, the unit 50 emits an electromagnetic energy containing the ID code by using the built-in battery as a driving source, or an electromagnetic energy containing the ID code is always kept emitted. In another method, which is designed to emit an electromagnetic energy containing the ID code without incorporating a power supply in the ID code unit 50, when a runner with the ID code unit 50 passes through one of the reader units 30A to 30F, the corresponding reader unit emits an electromagnetic energy in synchronism with the passage of the runner. When the antenna 56 arranged in the ID code unit 50 receives this electromagnetic energy, the LSI 55 incorporated in the unit 50 is driven by the electromagnetic energy as a driving source. As a result, an electromagnetic energy containing the ID code is emitted.

A seal 57 for displaying a racing number of a registration number is adhered on a side surface of the case 51. Identification information corresponding to this racing or registration number is programmed in the LSI 55 to be output as an ID code.

An operation of the embodiment will be described next.

In a marathon race, racing or registration numbers are assigned to the respective runners, and the ID code units 50 corresponding to the assigned numbers are respectively distributed to the runners while the seals 57 are checked. The respective runners run the race wearing the ID code units 50 on their wrists.

The reader units 30A to 30F are respectively arranged at the start point, the respective transitional points, and the finish point, and are activated so that detected ID codes, pieces of passage time information of the respective runners, and the reader numbers can be transmitted to the time measurement/recognition section 11 in the time measurement/recognition processing unit 10. In addition, the starter unit 20 is connected to the time measurement/recognition section 11. Before or after this operation, the ID codes of the respective runners and required data such as the names of the runners are input through the keyboard 15, thus registering the runners in the RAM 17 of the time measurement/recognition processing unit 10. With this operation, the number of runners and the ID codes of the respective runners are recognized.

Figure 5:
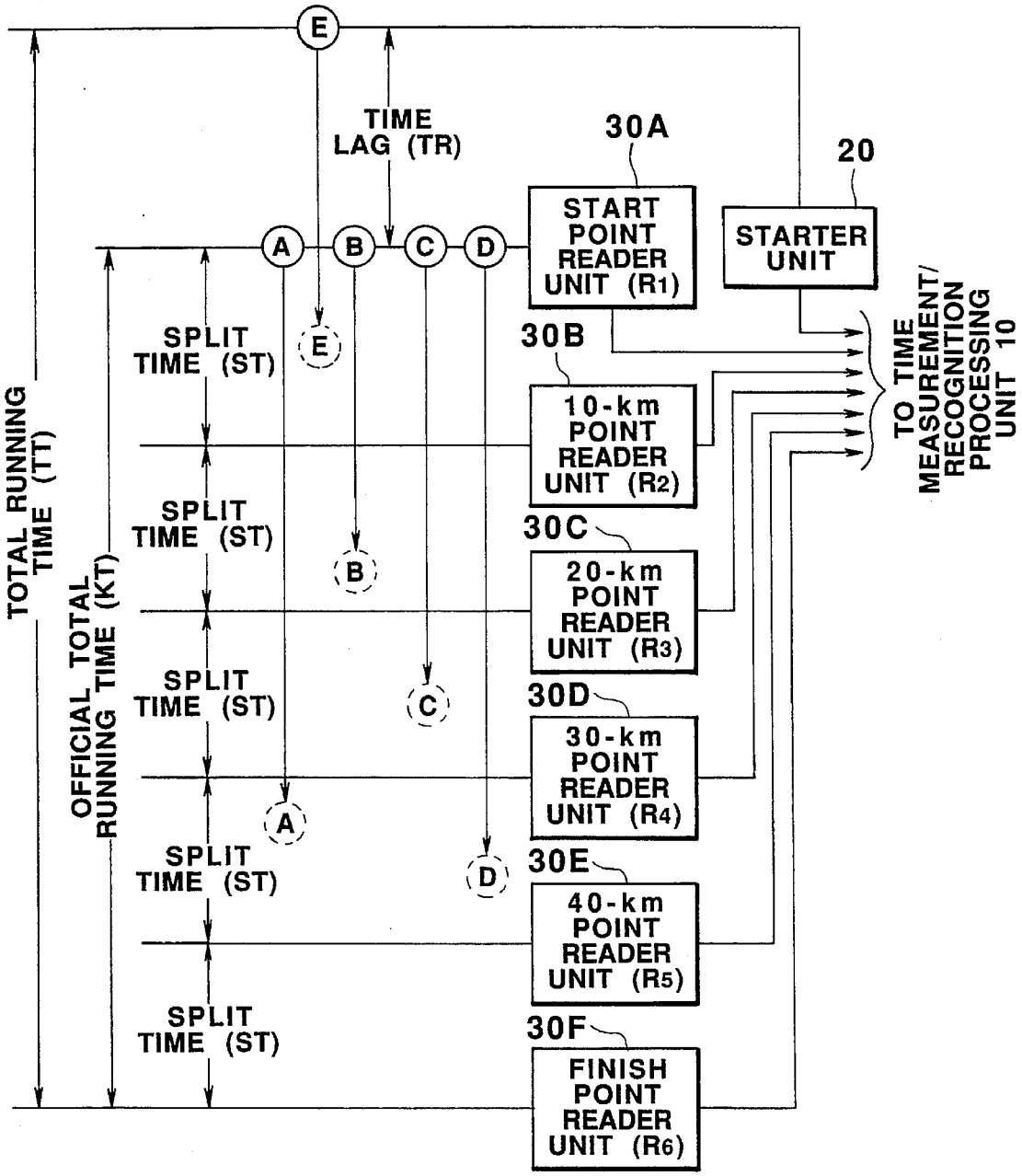
FIG. 5 is a view for explaining a case wherein a marathon race is performed by using the time measurement system according to the first embodiment of the present invention.

If, as shown in FIG. 5, the number of runners is so large that they cannot stand in a row along the start line, the runners who line up at the start line and the runners behind them pass the start line at different timings. For example, in the case shown in FIG. 5, although runners A to D pass through the start line at the signal for a race to start, a time lag is caused between the instant at which the signal is made and the instant at which a runner E passes through the start line.

For this reason, in the embodiment, as will be described later, the times at which the respective runners pass through the start line are detected by the reader unit 30A at the start point, and the intervals between the signal for the start and the times at which the respective runners pass through the start line are calculated as time lags, thereby calculating official start times, official total running times, and the like.

Figure 6:
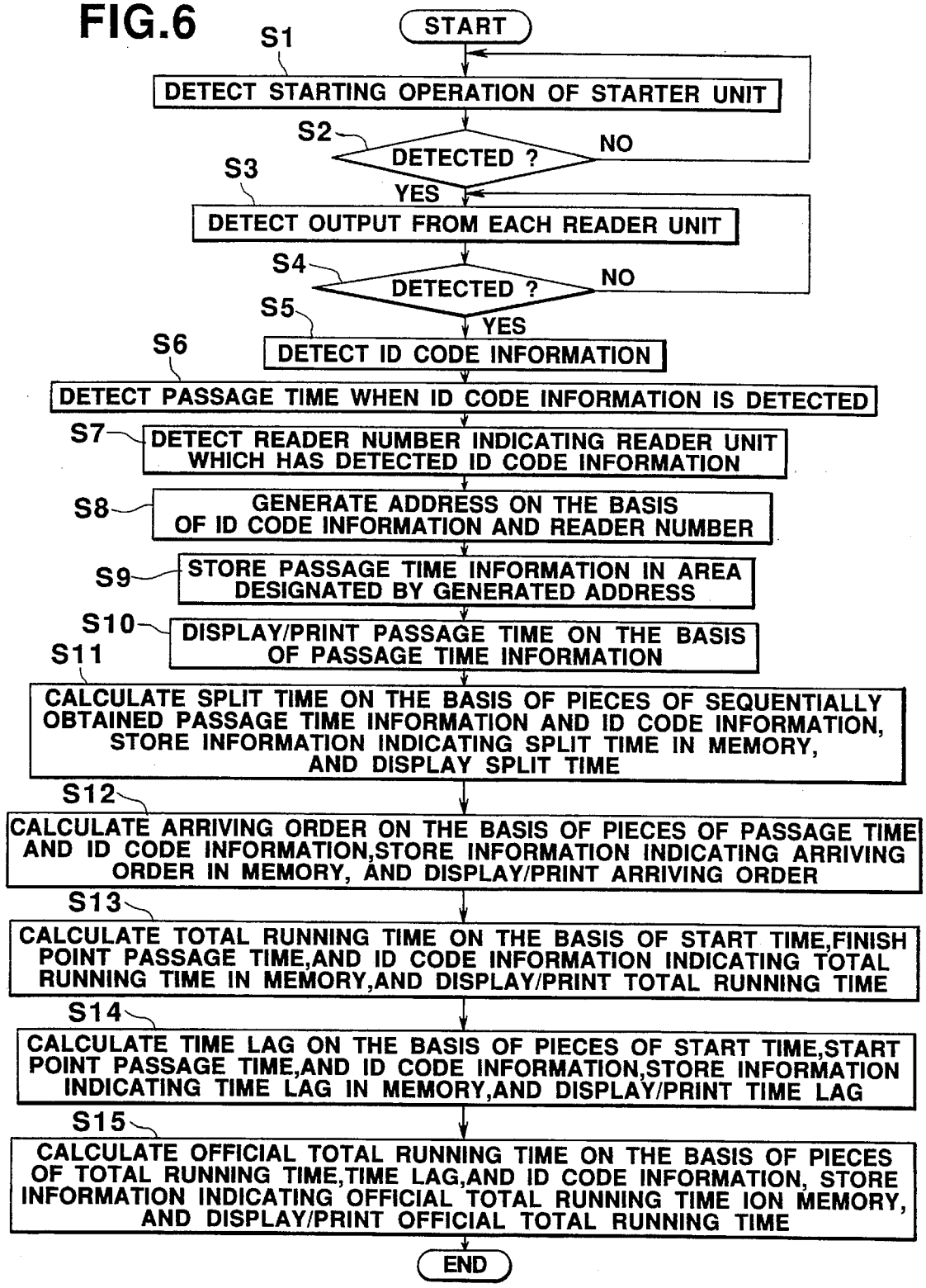
FIG. 6 is a flow chart showing processing in the first embodiment of the present invention.

In this state, when the runners gather at the start position and behind the start position, the starter unit 20 is operated. A starting signal is then input from the starter unit 20 to the time measurement/recognition section 11. The time measurement/recognition section 11 transmits this starting signal to the control section 12. The control section 12 is operated in accordance with the flow chart in FIG. 6. In step S1, the start of the operation of the starter unit 20 is detected in accordance with the presence/absence of the starting signal. If the starting signal is present in step S2, the flow advances to step S3. When each runner starts to run and passes through the start point, an electromagnetic energy containing the ID code is emitted from the ID code unit 50. The reader unit 30A installed at the start point receives this electromagnetic energy. Upon reception of the electromagnetic energy from the ID code unit 50, the reader unit 30A outputs a detection signal to the time measurement/recognition section 11 in step S3. If the reception of the detection signal is determined in step S4, the time measurement/recognition section 11 recognizes the ID code of the runner who has passed through the start line on the basis of the detection signal in step S5. In step S6, the time measurement/recognition section 11 then detects the passage time of the runner. In addition, in step S7, the time measurement/recognition section 11 detects the reader number R1 transmitted from the reader unit 30A installed at the start point. Upon detection of the reader number R1, the time measurement/recognition section 11 identifies the reader unit, of the reader units 30A to 30F, which detected the ID code. Detection of ID codes is performed by the respective reader units 30A to 30F every time the respective runners pass through the respective transitional points. By performing the same processing as described above, the times at which each runner passes through the respective reader units 30A to 30F are recognized on the basis of the ID code of the runner and the reader numbers R1 to R6 of the reader units 30A to 30F which read the ID code (steps S3 to s7).

Upon recognition of the ID code information and the reader numbers R1 to R6, the time measurement/recognition processing unit 10 generates addresses for storing the respective pieces of information shown in FIG. 3 in the RAM 17 in units of runners, i.e., ID codes (step S8). Pieces of passage time information TZ indicating the detected passage times are stored in areas, in the RAM 17, which are indicated by the generated addresses (step S9). The passage times are displayed, in units of runners, on the electric bulletin board or the display 13 through the electric bulletin board output port 16 on the basis of the pieces of passage time information TZ, and these passage times are printed on a recording paper sheet by the printer 14 (step S10).

Subsequently, split times of the respective runners are calculated on the basis of the sequentially stored pieces of passage time information TZ and ID code information, and pieces of split time information ST corresponding to the calculated split times are respectively stored in predetermined areas, in the RAM 17, designated by the corresponding ID codes. In addition, the split times corresponding to the pieces of split time information ST are displayed on the display 13 or the electric bulletin board and are printed on a recording paper sheet by the printer 14 (step S11).

In addition, the arriving orders of the respective runners at the respective transitional points every time the runner passes therethrough or the arriving orders of the respective runners between the respective transitional points are calculated on the basis of the respective pieces of passage time information TZ and corresponding ID code information, and the respective pieces of split time information ST and corresponding ID code information. The respective pieces of arriving order information TJ corresponding to the calculated arriving orders are stored in predetermined areas, in the RAM 17, designated by the corresponding ID codes. In addition, the arriving orders of the respective runners are displayed on the display 13 or the electric bulletin board, or are printed on a recording paper sheet by the printer 14 (step S12).

The total running times of the respective runners from the start time to the times at which they pass through the finish point are calculated on the basis of the start time at which the starter unit 20 is operated, the finish point passage times detected by the reader unit 30F, and the respective pieces of ID code information. Pieces of total running time information TT representing the calculated total running times are stored in predetermined areas, in the RAM 17, designated by the corresponding ID codes. In addition, the total running times represented by the pieces of total running information TT are displayed on the display 13 or the electric bulletin board and are recorded on a recording paper sheet by the printer 14 (step S13).

The time lags between the start time and the times at which the respective runners pass through the start point are calculated in units of runners on the basis of the start time, the start point passage times detected by the reader unit 30A, and the pieces of ID code information. Pieces of time lag information TR representing the time lags are stored in predetermined areas, in the RAM 17, designated by the corresponding ID codes. The time lags represented by the pieces of time lag information TR are displayed on the display 13 or the electric bulletin board, and are printed on a recording paper sheet by the printer 14 (step S14).

The official total running times of the respective runners are calculated on the basis of the pieces of total running time information TT, the pieces of time lag information TR, and the pieces of ID code information. The pieces of official total running time information KZA representing the official total running times are stored in predetermined areas, in the RAM 17, designated by the corresponding ID codes. In addition, the official total running times are displayed on the display 13 or the electric bulletin board, and are also printed on a recording paper sheet by the printer 14 (step S15).

The above-described processing is performed for each runner. With this processing, the total running times, the split times, the time lags, and the official total running times are measured in units of runners, and the arriving orders of the runners at the respective points are determined. These pieces of time and arriving order information can be stored in the RAM 17. The various time and arriving order information stored in the RAM 17 can be displayed in units of runners on the display 13 or the electric bulletin board, and can also be printed on a recording paper sheet by the printer 14. Therefore, even if a large number of runners pass through the respective transitional points with their arriving orders incessantly switched, and reach the finish point, measurement of the total running times of the respective runners, the splits times at the respective transitional points, and the like, and determination of the arriving orders of the respective runners at the respective transitional points and the finish point can be easily, accurately, and quickly performed without the mediacy of a large number of judges. In addition, even in a running race in which a very large number of runners participate, not only the time lags between the start time and the times at which the respective runners pass through the start point can be known, but also the official total running times from which these time lags are subtracted and which are measured from the times at which the respective runners pass through the start point to the times at which the runners pass through the finish point, and the official arriving orders of the runners can be determined.

Second Embodiment

FIGS. 7 to 14 show the second embodiment of the present invention.

Figure 7:
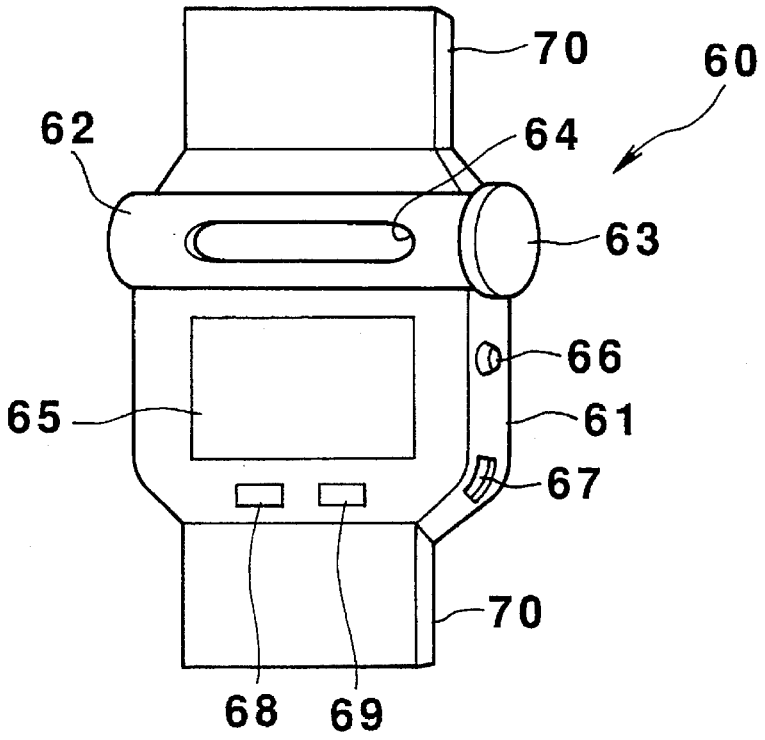
FIG. 7 is a perspective view of an electronic wristwatch according to the second embodiment of the present invention.

FIG. 7 is a perspective view showing an electronic wristwatch 60 as an electronic device according to the present invention.

A main body case 61 of the electronic wristwatch 60 has a tag room 62 whose one end is closed. A lid 63 is attached to an opening portion in the other end of the tag room 62. The lid 63 is threadably engaged with the opening portion in the other end of the tag room 62. The tag room 62 can be opened/closed by attaching/detaching the lid 63. An ID code tag 80 shown in FIG. 8 can be stored or removed by opening or closing the lid 63. A window 64 is formed in a portion of the tag room 62 of the main body case 61. The window 64 is constituted by a glass to protect the interior of the main body case 61.

Figure 11:
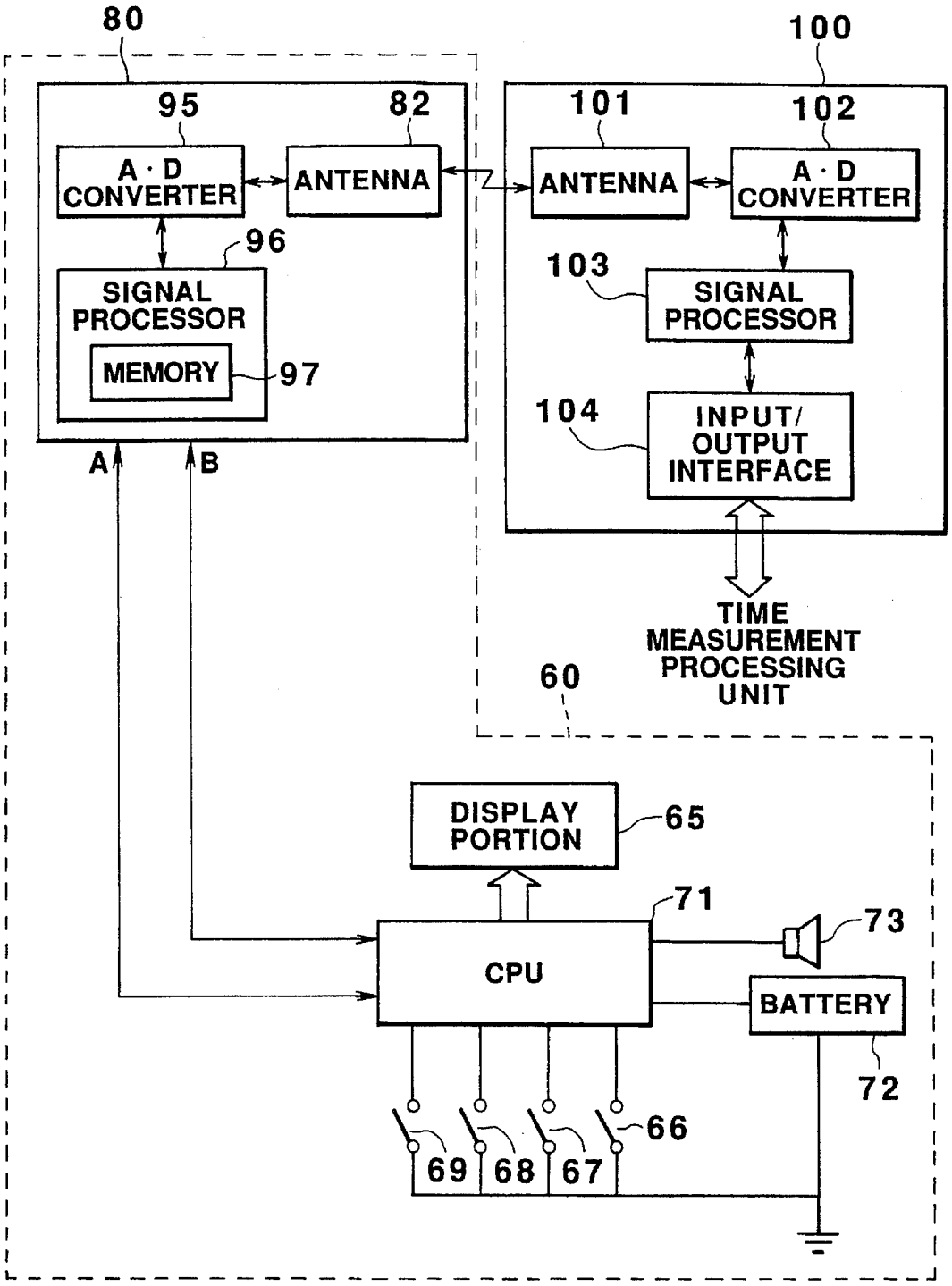
FIG. 11 is a block diagram showing the circuit arrangements of an electronic wristwatch and a reader unit according to the second embodiment of the present invention.

The main body case 61 incorporates a display portion 65 and switches 66 to 69 (see FIG. 11). The display portion 65 is constituted by, e.g., a liquid crystal display unit and is designed to display various kinds of information from the electronic wristwatch 60, e.g., the current time, total running times obtained in a stopwatch mode, split times, arriving orders, and the like. A band 70 is attached to the main body case 61. The electronic wristwatch 60 is worn on the wrist of each runner using the band 70.

Figure 8:
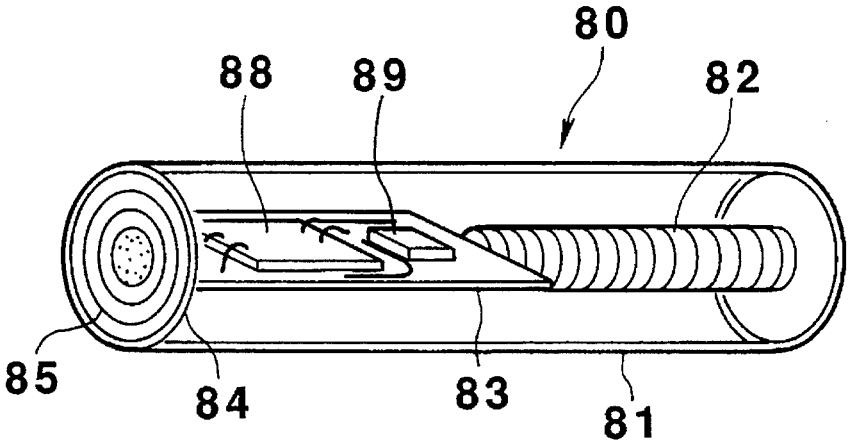
FIG. 8 is a perspective view of an ID code tag mounted in the electronic wristwatch in FIG. 7.
Figure 9:
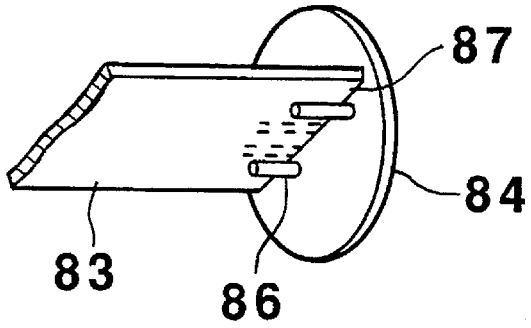
FIG. 9 is an enlarged perspective view showing the electrode plate portion of the ID code tag in FIG. 8.

As shown in FIG. 8, an antenna 82 and a circuit board 83 are housed in a cylindrical case 81 of the ID code tag 80. An electrode plate 84 is mounted on one bottom surface of the case 81. A plurality of concentrical electrodes 85 are formed on the electrode plate 84. As shown in FIG. 9, each electrode 85 is connected to a wiring pattern formed on the circuit board 83 through a pin 86. The circuit board 83 and the electrode plate 84 are fixed to each other through coupling pins 87. The coupling pins 87 are soldered to the electrode plate 84.

Referring to FIG. 8 again, in addition to this wiring pattern, an LSI (Large Scale Integrated Circuit) 88 and other circuit elements 89 are mounted on the circuit board 83. The LSI 88 and the circuit elements 89 are connected to the wiring pattern formed on the circuit board 83 by wire bonding.

The antenna 82 is connected to the wiring pattern on the circuit board 83 and is designed to receive an external electromagnetic energy and externally emit an electromagnetic energy.

Figure 10:
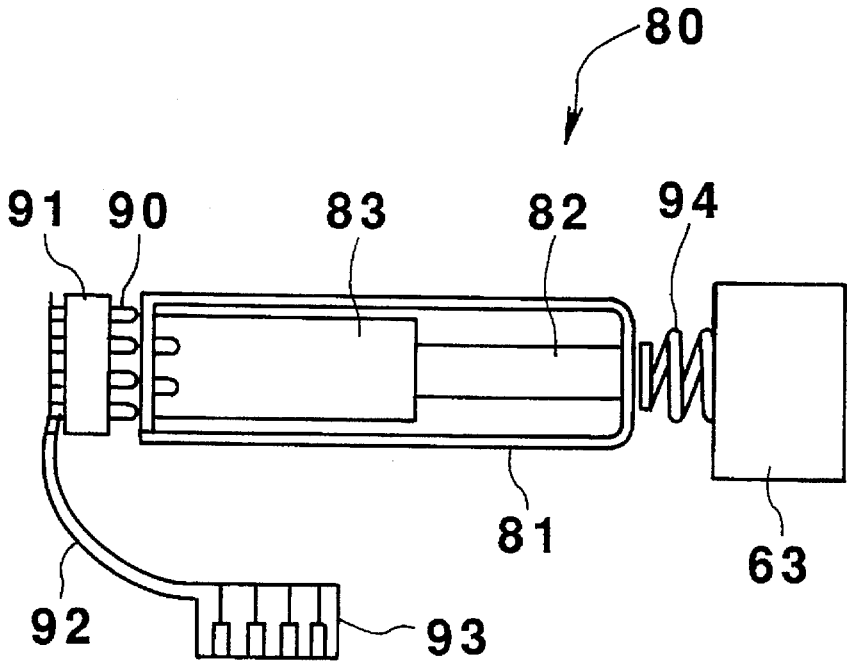
FIG. 10 is a view showing the state of connection between the ID code tag in FIG. 8 and an electrode with the ID code tag mounted in the electronic wristwatch in FIG. 7.

When the ID code tag 80 is housed in the tag room 62 of the electronic wristwatch 60, the electrodes 85 of the ID code tag 80 are brought into electrical contact with connect pins 90 formed in the tag room 62, and the connect pins 90 are connected to the circuit of the electronic wristwatch 60 shown in FIG. 11 through a base 91, a flexible cord 92, and an electrode plate 93, as shown in FIG. 10. In addition, when the lid 63 is closed while the ID code tag 80 is housed in the tag room 62, the electrode plate 84 of the ID code tag 80 is urged against the connect pins 90 by a spring 94 fixed to the lid 63, so that the electrode 85 and the connect pins 90 are brought into electrical contact with each other.

FIG. 11 is a block diagram showing the electronic wristwatch 60, the ID code tag 80, and a reader unit 100 as an external unit for transmitting/receiving electromagnetic waves between these components.

An A.D converter 95 and a signal processor 96 are formed on the circuit board 83 of the ID code tag 80, and a memory 97 is allocated in the signal processor 96.

The A.D converter 95 converts an analog signal contained in an electromagnetic wave received through the antenna 82 into a digital signal, and outputs it to the signal processor 96. In addition, the A.D converter 95 converts a digital signal input from the signal processor 96 into an analog signal and outputs it to the antenna 82.

The signal processor 96 is operated when the antenna 82 receives an electromagnetic wave transmitted from the outside. The signal processor 96 then reads out data from the memory 97 to output from the antenna 82 through the A.D converter 95, or causes the memory 97 to store a control signal for operating the circuit of the electronic wristwatch 60 or external data received by the antenna 82, or outputs it to the circuit of the electronic wristwatch 60.

For example, a ROM (Read Only Memory) or an EPROM (Electrically Programmable ROM), or the RAM as shown in FIG. 1 or FIG. 3 is used as the memory 97, in which arbitrarily preset data, newly set data, or the like is stored. For example, this data includes ID code, processing program, or instruction codes output to the circuit of the electronic wristwatch 60. If the memory 97 is constituted by an EPROM, the data can be updated. For example, the instruction codes stored in the memory 97 include the instruction codes shown in FIG. 12. Referring to FIG. 12, reference symbols A and B denote instruction codes respectively output through lines A and B in FIG. 11. The signal processor 96 serves to emit an ID code and the like stored in the memory 97, while they are contained in an electromagnetic wave, through the A.D converter 95 and the antenna 82, and also outputs the instruction code to the circuit of the electronic wristwatch 60.

As shown in FIG. 15, the storage area of the memory 97 has a first area which stores disqualification notification set time information STS, disqualification information CHT based on elapsed time, and excess time information CHO, each output from the measurement/recognition section 11, and a second area which stores all kinds of time information. In the second area, in units of ID codes, the following pieces of information are stored: time lag information TR, total running time information TT between the start and 10-km points, total runing time information TT between the start and 20-km points, official 10-km point elapsed time information KZ, official 20-km point elapesed time information KZ, split time information ST between the 10- and 20-km points split time information ST between the 20-and 30-km points, arriving order information TJ at the 10-km point, arriving order information TJ at the 20-km point, official arriving order information KT at 10-km point, official arriving order information KT at 20-km point, arriving order information TJ between the 10- and 20-km points, arriving order information TJ between the 20 and 30-km points, and the like.

Similar to the memory 97, the RAM 17 in the time measurement/recognition processing unit 10 has a first area which stores the disqualification notification set time information STT and the like, and a second area which stores all kinds of time information (see FIG. 3).

The electronic wristwatch 60 comprises not only a CPU 71, a battery 72, and a speaker 73 which outputs a buzzer sound or voice sound but also the display portion 65 and the switches 66 to 69. In addition, the electronic wristwatch 60 comprises an oscillator, a frequency divider, and the like (not shown).

For example, as the battery 72, a lithium battery is used. The battery 72 serves to supply power to each component of the electronic wristwatch 60. The CPU 71 stores programs for watch and stopwatch functions in the internal memory. The CPU 71 includes a work memory and serves to control each component of the electronic wristwatch 60 in accordance with the programs stored in the internal memory and perform time measurement processing, stopwatch processing, and the like.

The switches 66 to 69 are used to cause the electronic wristwatch 60 to perform various types of processing. The switch 66 is a start/stop switch for designating the start/stop of a stopwatch mode. The switch 67 serves to switch, e.g., lap and split modes. The switch 68 is a mode shift switch. The switch 69 is a numeric correction switch.

When an alarm time is set by operating the switches 66 to 69, and the current time reaches the set alarm time, the speaker 73 is driven by the CPU 71 to generate a buzzing sound.

Each reader unit 100 as an external unit comprises an antenna 101, an A.D converter 102, a signal processor 103, an input/output interface 104, and the like. Similar to the reader units 30A to 30F in the first embodiment, the reader units 100 are respectively installed at a start point, a 10-km point, a 20-km point, a 30-km point, a 40-km point, and a finish point in a marathon race. Reader numbers are respectively assigned to the reader units 100 at the respective points.

The antenna 101 is equivalent to the antenna 82 of the ID code tag 80 and is designed to externally emit an electromagnetic wave and receive an external electromagnetic wave. The A.D converter 102 converts an analog signal input through the antenna 101 into a digital signal, and outputs it to the signal processor 103. In addition, the A.D converter 102 converts a digital signal input from the signal processor 103 into an analog signal, and outputs it to the antenna 101.

A time measurement processing unit such as a personal computer used for a marathon race is directly connected to the input/output interface 104 through a connection cord. A transmitter 40 like the one shown in FIG. 2 is electrically connected to the input/output interface 104. The transmitter 40 serves to transmit various data input/output through the reader unit 100 to the time measurement/recognition processing unit 10 in the first embodiment, which is installed in the marathon race administrative section or the like, upon superposing the data on a predetermined electromagnetic wave.

The signal processor 103 controls each component of the reader unit 100 in accordance with a program stored in the internal memory to cause the reader unit 100 to perform processing.

More specifically, when the power supply is turned on, the reader unit 100 constantly emits an electromagnetic wave from the antenna 101. Upon reception of an electromagnetic wave from the ID code tag 80 of the electronic wristwatch 60, the reader unit 100 reads out data, e.g., an ID code and the like, contained in the electromagnetic wave, and outputs the data through the input/output interface 104. In addition, the reader unit 100 outputs various types of time measurement data, such as an elapsed time since the start of the race and a split time at each transitional point, supplied from the time measurement/recognition processing unit 10, from the antenna 101 upon superposing the data on an electromagnetic wave.

An operation of the second embodiment will be described next.

Similar to the first embodiment, a marathon race is exemplified in the second embodiment.

In this case, racing numbers or registration numbers are assigned to the respective runners, and the ID code tags 80 corresponding to the assigned numbers and number seals 110 having the assigned numbers (see FIG. 13) are distributed to the respective runners. Each runner stores the assigned ID code tag 80 in the tag room 62, and sticks the assigned number seal 110 on the window 64. Thereafter, he or she wears the electronic wristwatch 60 on his or her wrist through the band 70. The respective runners run the race wearing the electronic wristwatches 60 on their wrists.

The reader units 100 are respectively arranged at the start point, the finish point, and the respective transitional points in the same manner as shown in FIG. 5. The reader units 100 are electrically connected to the time measurement/recognition processing unit 10 through cables. Alternatively, each reader unit 100 may be set such that data can be transmitted by radio from the transmitter 40 to the time measurement/recognition processing unit 10 through the receiver arranged on the unit 10 side.

Subsequently, the required data such as the ID codes and names of the runners who participate in the race are input to the time measurement/recognition processing unit 10, thus completing registration of the runners. When the installation of the reader units 100 is completed, an electromagnetic wave is transmitted from the time measurement/recognition processing unit 10 to each reader unit 100, and each reader unit 100 starts to output the transmitted electromagnetic wave.

When the runners gather at the start point, and the starter unit is operated in this state, a starting signal from the starter unit is input to the time measurement/recognition processing unit 10. As a result, the time measurement/recognition processing unit 10 starts to perform time measurement such as measurement of the total running times of at least the runners who are registered or an operation of determining the arriving orders of the respective runners.

Figure 14:
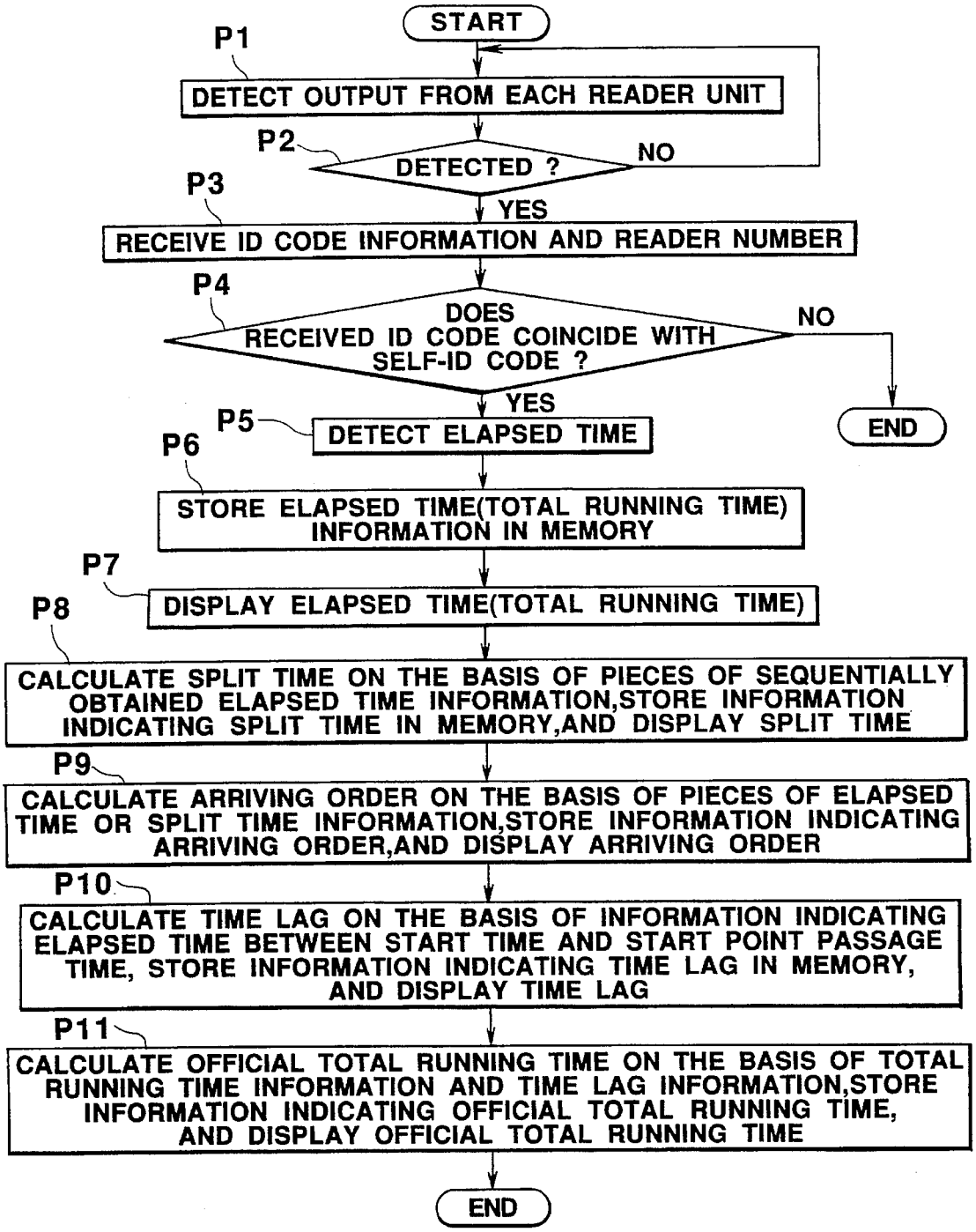
FIG. 14 is a flow chart showing processing in the second embodiment of the present invention.

When a starter unit 20 (see FIG. 1) is operated, each runner operates the switch 66 of the electronic wristwatch 60 in synchronism with the operation of the starter unit 20 to start time measurement. When the electronic wristwatch 60 is started upon operation of the switch 66, the electronic wristwatch 60 scans an output from each reader unit 100 to detect the presence/absence of the output, as shown in FIG. 14 (steps P1 and P2).

When each runner starts running and passes through the start point, the antenna 82 of the ID code tag 80 housed in the electronic wristwatch 60 worn on the wrist of each runner receives an electromagnetic wave emitted from the reader unit 100 installed at the start point (step P3). Upon reception of the electromagnetic wave, the ID code tag 80 extracts ID code information and a reader number from the received electromagnetic wave. In addition, in the ID code tag 80, the signal processor 96 reads out the self-ID code stored in the memory 97. It is then checked in step P4 whether the self-ID code coincides with the received ID code. If NO in step P4, the electronic wristwatch 60 determines that the information from the reader unit 100 is irrelevant, and the processing is ended. If YES in step P4, the time at which the electromagnetic wave from the reader unit 100 is received is detected as the elapsed time since the instant at which each runner has passed through the start point (step P5).

When the elapsed time is detected, elapsed time information corresponding to the detected elapsed time is stored, as total running time information TT, in a predetermined area in the memory 97 of the signal processor 96 (step P6). The elapsed time is displayed/output on the basis of the elapsed time information (total running time information TT) (step P7).

When the electronic wristwatch 60 receives the electromagnetic wave from the reader unit 100 at the start point, the signal processor 96 of the ID code tag 80 in the electronic wristwatch 60 immediately outputs the ID code read out from the memory 97 upon superposing it on an electromagnetic wave. The reader unit 100 reads this ID code and outputs it to the time measurement/recognition processing unit 10. In addition, the signal processor 96 of the ID code tag 80 reads out a stopwatch start code from the memory 97 and outputs it to the CPU 71. Upon reception of the stopwatch start code, the CPU 71 starts the stopwatch function.

Consequently, time measurement is started by the time measurement/recognition processing unit 10 of the administrative section, and time measurement for each runner by means of the electronic wristwatch 60 in the stopwatch mode is started when each runner passes through the start point.

When each runner passes through the 10-km point in the process of running the race, an electromagnetic wave is transmitted from the reader unit 100 installed at the point to the ID code tag 80 of the electronic wristwatch 60 worn on the wrist of the each runner. Upon reception the electromagnetic wave, the ID code tag 80 reads out the ID code from the memory 97, as in the case described above, and transmits it to the reader unit 100 upon superposing it on an electromagnetic wave. Upon reception of the ID code, the reader unit 100 outputs the received ID code to the time measurement/recognition processing unit 10. The time measurement/recognition processing unit 10 measures the elapsed time between the start time and the time at which each runner passes through the 10-km point, as a total running time, for each ID code received.

Elapsed time information (total running time information TT) representing each measured elapsed time is stored in the memory 97 (step P6). At the same time, each elapsed time (total running time) is displayed on the display portion 65 on the basis of the corresponding elapsed time information (total running time information TT) (step P7).

In addition, split times between the respective transitional points are calculated on the basis of the pieces of stored elapsed time information (total running time information) TT. More specifically, the split times of each runner are calculated on the basis of the elapsed time between the start time and the instant at which each runner passes through the previous transitional point, and the elapsed time between the start time and the instant at which each runner passes through the current transitional point. Pieces of split time information ST representing the calculated split times are stored in the memory 97. At the same time, the split times are displayed on the display portion 65 on the basis of the pieces of the split time information (step P8).

Furthermore, the arriving order of each runner at each transitional point is calculated on the basis of these pieces of elapsed time (total running time) and split time information. Arriving order information TJ representing the calculated arriving order of each runner is transferred to the ID code tag 80 and is stored in the memory 97. At the same time, the arriving order is displayed on the display portion 65 (step P9).

When each runner sequentially passes through the respective transitional points as the race proceeds, similar to the above operation, the ID code tag 80 is operated by an electromagnetic wave from the reader unit 100 at each transitional point to output the ID code to the reader unit 100, and also outputs an instruction code to the CPU 71 to measure the elapsed time (total running time) between the start time and the instant at which each runner passes through each transitional point, and the split times between the respective transitional points, and to determine-the arriving order of each runner at each transitional point in the same manner as described above. The elapsed times (total running times) and the split times between the respective transitional points measured by the CPU 71, and the determined arriving orders at the respective transitional points are stored in the memory 97.

When the respective runners pass through the finish point at the end of the race, the ID code tag 80 carried by each runner receives an electromagnetic wave from the reader unit 100 installed at the finish point. The electromagnetic wave emitted from the reader unit 100 at the finish point contains a code for stopping the stopwatch mode of the electronic wristwatch 60. Upon reception of the electromagnetic wave from the reader unit 100, similar to the above-described operation, the ID code tag 80 outputs the ID code to the reader unit 100, reads out the stop instruction code from the memory 97, and outputs it to the CPU 71. In response to the stop instruction, the CPU 71 stops the stopwatch mode, calculates the split time between the 40-km point and the finish point, and determines the arriving order of the corresponding runner at the finish point. The CPU 71 then stores the resultant data in the memory 97, and displays them (steps P3 to P9).

Furthermore, each CPU 71 measures the time lag between the start time and the instant at which the corresponding runner has passed through the start point, and stores time lag information TR representing the measured time lag in the memory 97. At the same time, the CPU 71 displays the measured time lag on the display portion 65 (step P10). In addition, the CPU 71 calculates an official total running time, as total running time information KT, on the basis of the total running time information and the time lag information TR obtained by the above time measurement. The CPU 71 stores the total running time information KT in the memory 97 and displays it on the display portion 65 (step P11).

As described above, according to the second embodiment, the time measurement/recognition processing unit 10 in the administrative section can detect a specific rune who passes through each transitional point and a finish point on the basis of the ID code contained in an electromagnetic wave emitted from the ID code tag 80 of the electronic wristwatch 60 attached to the runner. Therefore, the official total runing times and split times of each runner can be measured. In addition, since the elasped time between the start time and the instant at which each runner passes through the start point is detected by the reader unit 100, the total running time and split times of each runner with respect to the time at which each runner actually passes though the start point can be measured, and the measurement results can be stored as time information.

Moreover, in addition to split times and total running times, a time lag, official total running times, and arriving orders at the respective points can be stored in the memory 97 and displayed on the display portion 65 of the electronic wristwatch 60 carried by each runner, as shown in FIG. 15. Therefore, each runner need not go to the administrative section to ask his/her own split times, total running times, and the like, but can immediately obtain the required time information. Furthermore, the time measurement results for each runner are written into the RAM 17 in the time measurement/recognition processing unit 10. As a result, the administrative section need not hand out recording sheet papers, on which the split times, total running times, and the like of the respective runners are printed, to a large number of participants, respectively, thereby omitting a cumbersome operation in the management of the race.

In the second embodiment, split times and official total times are calculated by the electronic wristwatch 60 carried by each runner. However, the present invention is not limited to this. For example, similar to the embodiment shown in FIG. 1, these time data may be calculated by the time measurement/recognition processing unit 10. In this case, when each runner passes through a transitional point or a finish point, an electromagnetic wave containing the calculated time data is transmitted from the corresponding reader unit 100 to the ID code tag 80 of the runner to store the split times and the official total running times in the memory 97 of the ID code tag 80.

Third Embodiment

Figure 17:
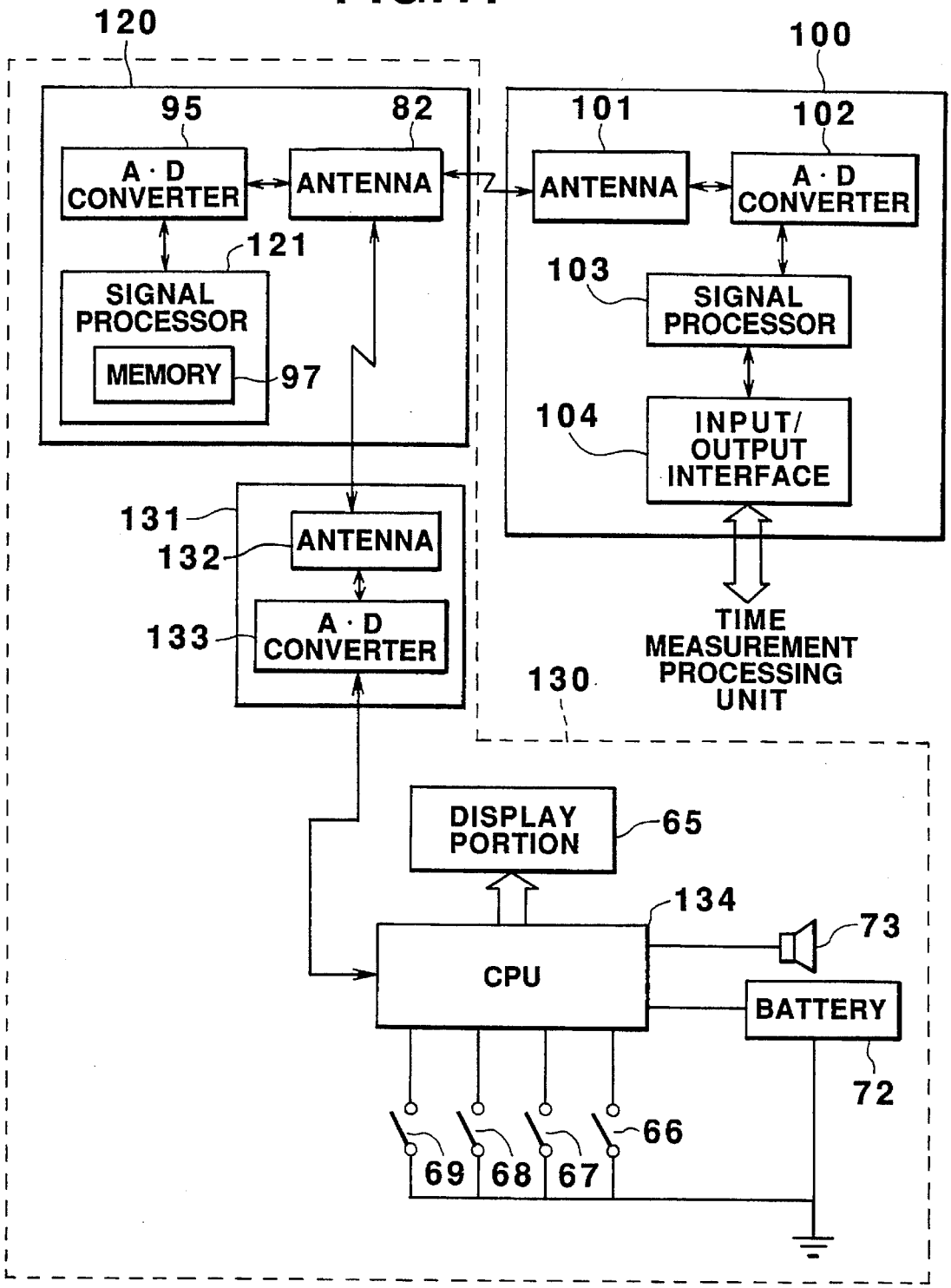
FIG. 17 is a block diagram showing the circuit arrangements of an electronic wristwatch and a reader unit according to the third embodiment of the present invention.

FIGS. 16 and 17 show the third embodiment of the present invention.

This embodiment is different from the above-described second embodiment in that data are exchanged between an ID code tag and the circuit of an electronic wristwatch through antennas respectively arranged therein. The same reference numerals in the third embodiment denote the same parts as in the above second embodiment, and a description thereof will be omitted.

FIG. 16 is a perspective view of an ID code tag 120. The ID code tag 120 has an antenna 82 and a circuit board 83 housed in a cylindrical case 81, and an LSI 88 and circuit elements 89 are mounted on the circuit board 83 with a wiring pattern formed thereon, similar to the second embodiment. However, no electrode plate is fixed to one bottom surface of the case 81.

FIG. 17 is a block diagram showing an electronic wristwatch 130 including an ID code tag 120, and a reader unit 100.

In the third embodiment, communication is performed between the ID code tag 120 and the electronic wristwatch 130 by using electromagnetic energy or the like as with the case of communication between the reader unit 100 and the electronic wristwatch 130.

For this purpose, a signal processor 121 of the ID code tag 120 stores a program for such communication. Other arrangements of the signal processor 121 are the same as those in the second embodiment.

The electronic wristwatch 130 includes a communication section 131 for communication with the ID code tag 120. The communication section 131 is constituted by an antenna 132 and an A.D converter 133. Other arrangements of the electronic wristwatch 130 are the same as those of the electronic wristwatch 60 in the second embodiment. However, the electronic wristwatch 130 is different from the electronic wristwatch 60 in that a CPU 134 has a program and the like for performing communication with the ID code tag 120 through the communication section 131.

In this embodiment, data are also exchanged between the ID code tag 120 and the circuit of the electronic wristwatch 130 through the antennas 82 and 132 respectively arranged therein. Therefore, similar to the above-described embodiment, when a large number of runners pass through predetermined transitional points and reach the finish line while their arriving orders are switched now and then, not only split and total running times but also a time lag, official total running times, and arriving order of each runner can be displayed, at the respective points, on a display portion 65 formed on the electronic wristwatch 130 carried by each runner. In addition, the measured results can be stored in a memory 97.

Fourth Embodiment

Figure 18:
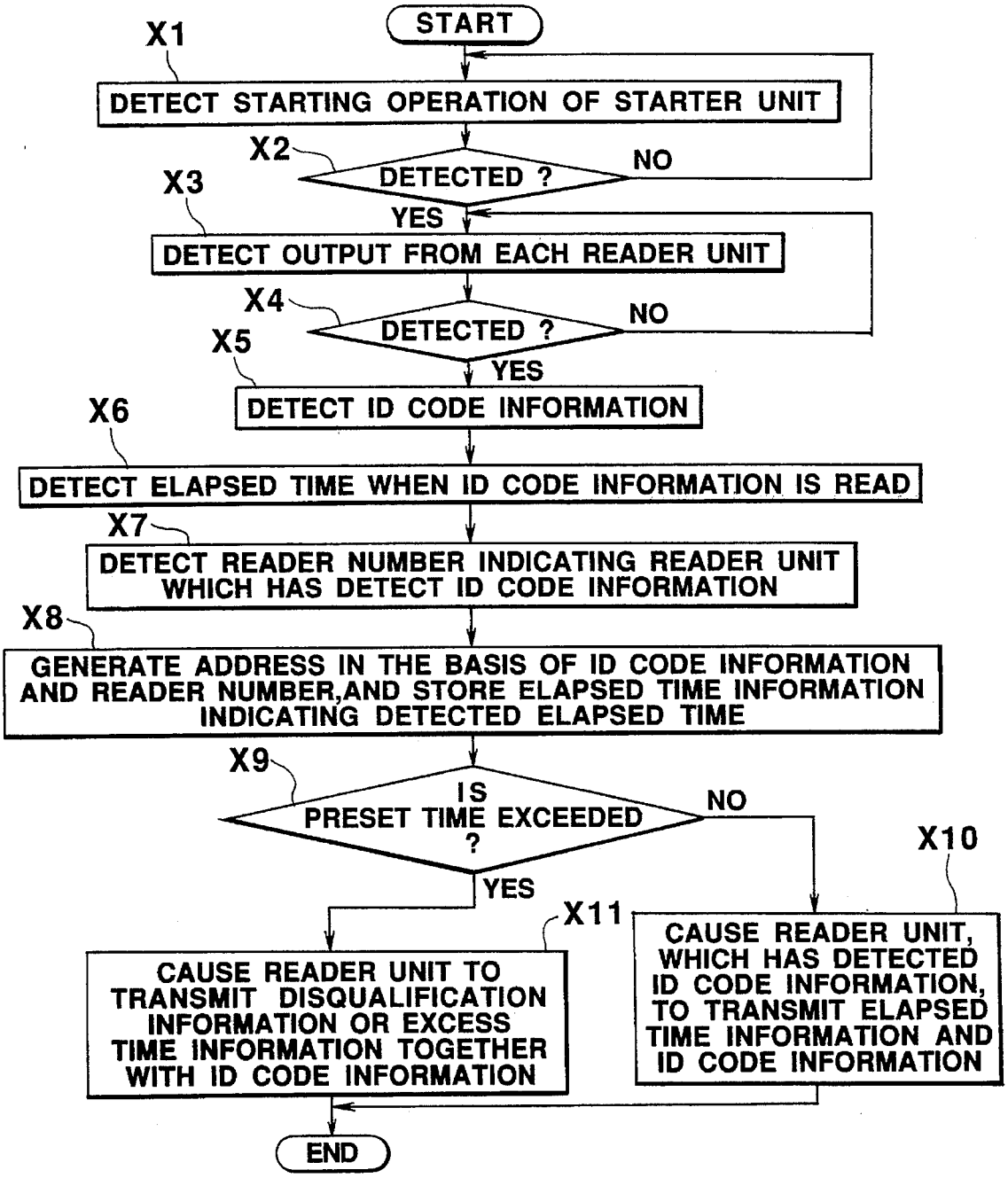
FIG. 18 is a flow chart showing processing in a time measurement apparatus according to the fourth embodiment of the present invention.
Figure 19:
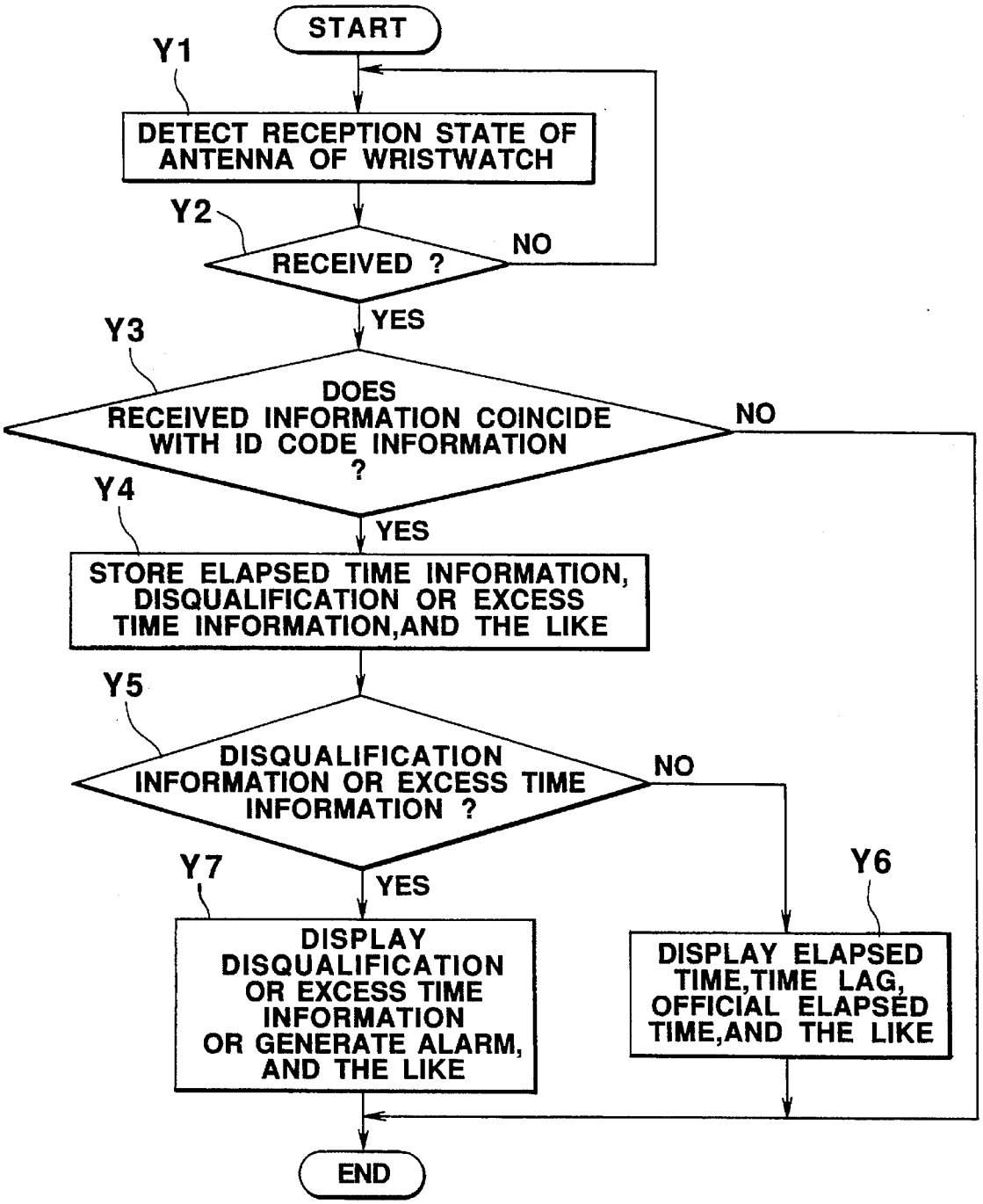
FIG. 19 is a flow chart showing processing according to the fourth embodiment of the present invention.

FIGS. 18 and 19 show the fourth embodiment of the present invention.

In each embodiment described above, the total running times, split times, and the like of each of a large number of runners are measured, and the arriving order of each runner is determined. In the fourth embodiment shown in FIGS. 18 and 19, if it is determined that the running time of each runner exceeds a preset time while an electronic wristwatch 60 as a moving object which moves as the runner runs a race, every time the runner passes through an external transmission unit, corresponding movement-associated information is transmitted from the corresponding external transmission unit. Therefore, by receiving this movement-associated information through the electronic wristwatch 60, each runner himself/herself can quickly and reliably know disqualification information on the basis of the received information.

The same reference numerals in the fourth embodiment denote the same parts as in the embodiments, and a description thereof will be omitted.

Processing of a control section 12 for achieving such an object will be described below with reference to FIG. 18.

In a marathon race, each runner wears the electronic wristwatch 60 including an ID code tag 80 on his/her wrist (see FIG. 13). Reader units 100 are installed at the start point, the respective transitional points, and the finish point, and are activated so that data can be transmitted/received to/from a time measurement/recognition section 11 of each time measurement/recognition processing unit 10 (see FIG. 1). A starter unit 20 is connected to the time measurement/recognition section 11. Thereafter, required data such as the ID codes and names of the respective runners are input through a keyboard 15 to register the runners in a RAM 17 of the time measurement/recognition processing unit 10.

When the starter unit 20 is operated after the runners gather at the start point, the control section 12 detects in step X1 whether the starter unit 20 is operated. If an operation of the starter unit 20 is detected in step X2, a starting signal is input from the starter unit 20 to the time measurement/recognition section 11. The time measurement/recognition section 11 starts time measurement of all the registered runners in synchronism with the starting signal. In step X3, the time measurement/recognition section 11 detects the presence/absence of a detection output from each reader unit 100.

Similar to the case of the second embodiment, when each runner starts to run at the signal for a race to start, given by the starter unit 20, and passes through the start point, an electromagnetic energy containing the ID code is emitted from the ID code tag 80. This electromagnetic energy is then received by the reader unit 100. If it is determined in step X4 that the energy is received from the ID code tag 80, the reader unit 100 outputs a detection signal to the time measurement/recognition section 11. In step X5, the ID code of the runner who has passed through the start point is recognized on the basis of this output signal. Furthermore, in step X6, the elapsed time between the start time and the instant at which the runner has passed the start point is detected. In step X7, the time measurement/recognition section 11 identifies the reader unit 100 which has detected the ID code, by detecting the reader number (one of reader numbers R1 to R6) of the corresponding reader unit 100.

Such detection processing by each reader unit 100 is performed every time each runner passes through each transitional point, and the same processing as described above is performed to recognize the elapsed time between the start time and the instant at which each runner passes through each reader unit 100 on the basis of the reader number (one of the reader numbers R1 to R6) of each reader unit 100 which has read the ID of each runner (steps X3 to X7).

Upon recognition of the pieces of ID code information and the reader numbers R1 to R6, the time measurement/recognition processing unit 10 generates addresses for storing the respective pieces of information shown in FIG. 3 in units of runners, i.e., ID codes, in the RAM 17 on the basis of the pieces of Id code information and the reader numbers R1 to R6. In step X8, pieces of elapsed time information representing the recognized elapsed times are stored in areas designated by the generated addresses.

The above processing is the same as that described with the reference to the flow chart in FIG. 14 in the third embodiment.

In step X9, the control section 12 compares each elapsed time information with the present time information stored in the RAM 17 (the information STS in FIG. 15) to check whether the running time of the corresponding runner exceeds the preset time.

If NO in step X9, the control section 12 transmits the elapsed time information and ID code information corresponding to this elapsed time information to the reader unit 100 which has detected the ID code information, and causes the reader unit 100 to transmit them in step X10. With this operation, the processing is ended.

If YES in step X9, the control section 12 transmits disqualification information indicating that the runner is disqualified, and ID code information corresponding to the disqualification information to the reader unit 100 which has detected the ID code information, and causes the reader unit 100 to transmit them (step X11). With this operation, the processing is ended. In this case, instead of or in addition to the disqualification information, excess time information indicating an excess of time over the preset time may be transmitted together with the ID code information.

On the other hand, as shown in FIG. 19, in step Y1, the electronic wristwatch 60 checks the reception states of various kinds of information received through an antenna 82. If reception of information is determined in step Y2, it is checked in step Y3 whether the received ID code coincides with the self-ID code, i.e., whether the received ID code matches with the self-ID code. If NO in step Y3, it is determined that the information is irrelevant, and the processing is ended. If YES in step Y3, time information such as elapsed time information, or disqualification information or excess time information is extracted from the contents received and is stored in a memory 97 in step Y4.

In step Y5, it is checked whether the received information is disqualification information or excess time information. If NO in step Y5, the received elapsed time information, time lag information, and official elapsed time information are displayed on a display portion 65 in step Y6. With this operation, the processing is ended. If it is determined in step Y5 that the received information is disqualification information, in step Y7, disqualification is displayed on the display portion 65, and a buzzing sound is generated or disqualification or excess time is informed with voice sound. In the step Y7, if excess time information is received, the excess time is displayed on the display portion 65. With this operation, the processing is ended.

The above processing is performed every time data are received from one of the reader units 100. When the above processing is performed upon reception of data from the reader unit 100 installed at the finish point, or the above output processing is performed upon reception of disqualification information, the processing is ended.

As described above, if a given runner does not pass through one of the reader units 100 within a preset time, disqualification information or excess time information can be transmitted to the electronic wristwatch 60 carried by the runner at the instant at which the present time is exceeded or the runner passes through the reader unit 100. Therefore, disqualification can be reliably and easily informed to a disqualified runner without the mediacy of a person unlike the conventional management of a running race. This saves the expenses of management of a marathon race, and allows proper management of the race. In addition, a runner whose elapsed time exceeds the preset time receives disqualification information or excess time information through the electronic wristwatch 60 carried by the runner. Information indicating disqualification or an excess time is then displayed on the display portion on the electronic wristwatch 60, or the runner is alarmed with a buzzing sound or the like. With this operation, the runner can obtain the information and hence can immediately know that he/she is disqualified. As a result, an unnecessary continuation of the race can be prevented.

Figure 20:
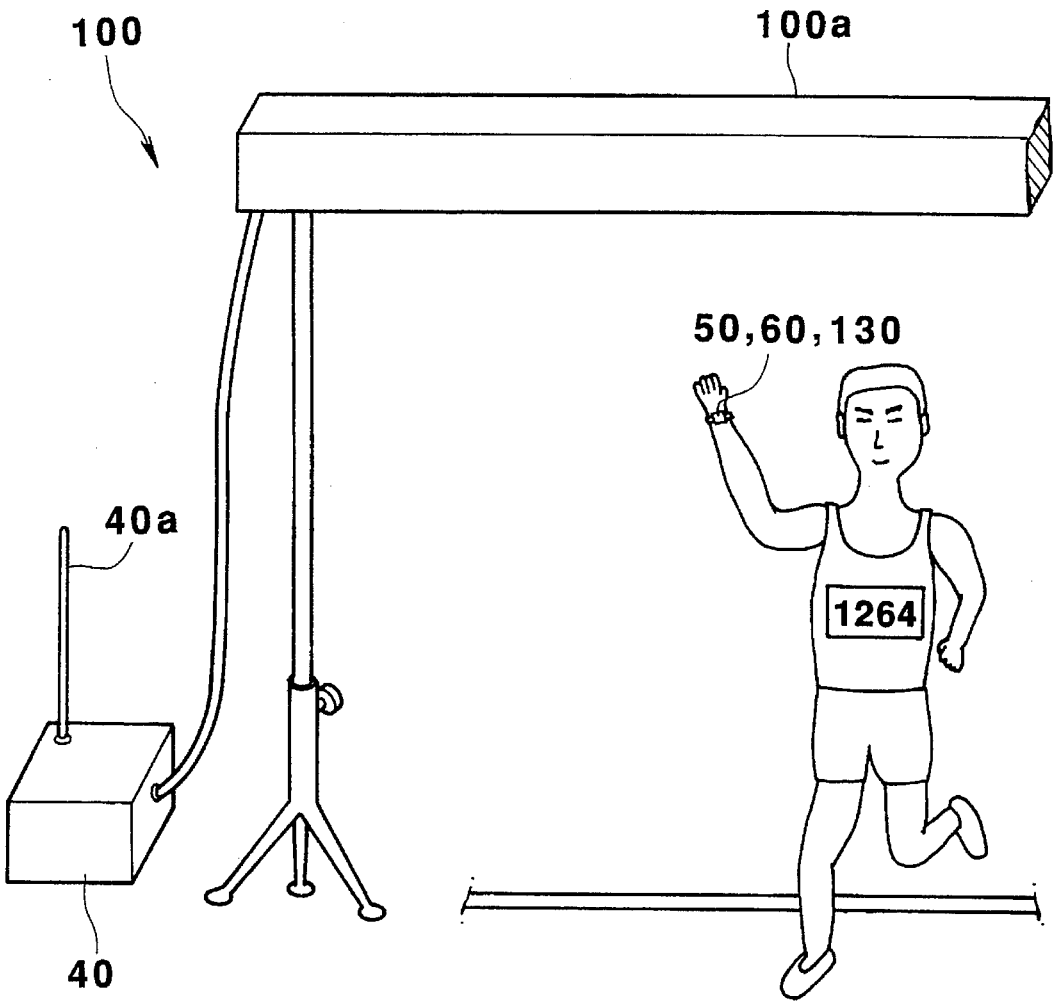
FIG. 20 is a view showing another example of how the reader unit is installed.

In each embodiment described above, the reader units 100 arranged at the respective transitional points may be installed on the sides of the start line, the finish line, and the respective transitional point lines, as shown in FIG. 2. However, the present invention is not limited to this. For example, as shown in FIG. 20, reader members 100a constituting the reader units 100 may be arranged above the start line, the finish line, and the respective transitional point lines. With this arrangement, even if a plurality of runners run side by side and pass through a line, passage times and elapsed times can be accurately detected, and information can be accurately exchanged between the reader member 100*a* and electronic wristwatches 50, 60, and 130.

In addition, according to each embodiment described above, the present invention is applied to a marathon race. However, the present invention is not limited to this. For example, the present invention can be equally applied to 100- and 200-m runs. Moreover, in addition to running races, the present invention can be applied to other cases, e.g., a case wherein a plurality of objects to be checked, which are mounted on a belt conveyor, are moved to the end point (finish point) through predetermined processes, and a case wherein moving objects (e.g., vehicles) pass through the respective points and move to the finish point. In such a case, the present invention can be used to determine the total moving times, required times in predetermined intervals (split times), and the like of the respective objects.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A time measurement apparatus comprising:

identification information receiving means, respectively arranged at a plurality of points through which a plurality of moving objects, each of which independently transmits moving object identification information, sequentially pass, for receiving pieces of moving object identification information respectively transmitted from the moving objects every time the moving objects pass through the respective points; and information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

and wherein:

said moving objects are mounted on a respective user's arm;

said moving objects comprise respective wristwatches, each wristwatch having a display for displaying a current time, and transmitting means for transmitting said moving object identification information; and said transmitting means is detachably attached to said respective wristwatches.

2. An apparatus according to claim 1, further comprising:

movement start time point detecting means for detecting a movement start time point of the wristwatches, total time measurement means for measuring total times between the reception time points indicated by the pieces of reception time point information output from said information output means and the movement start time point, and total time information output means for outputting pieces of total time information indicating the total times measured by said total time measurement means, and the pieces of moving object identification information corresponding to the pieces of total time information.

3. An apparatus according to claim 1, further comprising:

split time measurement means for measuring split times between reception time points at which the pieces of moving object identification information are sequentially received, in units of wristwatches, by adjacent identification information receiving means, of said plurality of identification information receiving means, and split time information output means for outputting pieces of split time information indicating the split times measured by said split time measurement means, and the pieces of moving object identification information corresponding to the pieces of split time information.

4. An apparatus according to claim 1, further comprising:

passing order determining means for determining passing orders of the respective wristwatches on the basis of the pieces of moving object identification information and reception time point information output from said information output means, and arriving order information output means for outputting pieces of passing order information indicating the passing orders determined by said passing order information determining means, and the pieces of moving object identification information corresponding to the pieces of passing order information.

5. An apparatus according to claim 2, further comprising:

arriving order determining means for determining arriving orders of the respective moving objects on the basis of the pieces of moving object identification information and total time information output from said total time information output means, and arriving order information output means for outputting pieces of arriving order information indicating the arriving orders determined by said arriving order determining means, and the pieces of moving object identification information corresponding to the pieces of arriving order information.

6. An apparatus according to claim 3, further comprising:

arriving order determining means for determining arriving orders of the respective moving objects on the basis of the pieces of moving object identification information and split time information output from said split time information output means, and arriving order information output means for outputting pieces of passing order information indicating the passing orders determined by said arriving order information determining means, and the pieces of moving object identification information corresponding to the pieces of arriving order information.

7. An apparatus according to claim 1, further comprising:

movement start time point detecting means for detecting a movement start time point of the plurality of moving objects, time lag measurement means for measuring times, as time lags, between reception time points at which the pieces of moving object identification information are received by said identification information receiving means, of said plurality of identification information means, which is located at a first point through which the respective moving objects pass, and the movement start time point detected by said movement start time point detecting means, and time lag information output means for outputting pieces of time lag information indicating the time lags measured by said time lag measurement means, and the pieces of moving object identification information corresponding to the pieces of time point lag information.

8. An apparatus according to claim 7, further comprising:

total time measurement means for measuring total times between the reception time points indicated by the pieces of reception time point information output from said information output means and the movement start time point, and official total information output means for outputting pieces of official total time information indicating official total times obtained by subtracting the pieces of time lag information measured by said time lag measurement means from the total times measured by said total time measurement means, and the pieces of moving object identification information corresponding to the pieces of official total time information.

9. An apparatus according to claim 7, further comprising:

arriving order determining means for determining arriving orders of the respective moving objects on the basis of the pieces of moving object identification information and time lag information output from said time lag information output means, and arriving order information output means for outputting pieces of arriving order information indicating the arriving orders determined by said arriving order determining means, and the pieces of moving object identification information corresponding to the pieces of arriving order information.

10. An apparatus according to claim 8, further comprising:

arriving order determining means for determining arriving orders of the respective moving objects on the basis of pieces of moving object identification information and official total time information output from said official total time information output means, and arriving order information output means for outputting pieces of arriving order information indicating the arriving orders determined by said arriving order determining means, and the pieces of moving object identification information corresponding to the pieces of arriving order information.

11. An apparatus according to claim 2, further comprising:

excess time determining means for comparing a preset time with each total time indicated by the total time information output from said total time information output means, and for determining whether the total time exceeds the preset time, and output means for outputting one of (a) excess time information and (b) information associated with excess time information when said excess time determining means determines that the total time exceeds the preset time.

12. An apparatus according to claim 3, further comprising:

excess time determining means for comparing a preset time with each split time indicated by the split time information output from said split time information output means, and for determining whether the split time exceeds the preset time, and output means for outputting excess time information or information associated with excess time information when said excess time determining means determines that the split time exceeds the preset time.

13. An apparatus according to claim 7, further comprising:

excess time determining means for comparing a preset time with each time lag indicated by the time lag information output from said time lag information output means, and for determining whether the time lag exceeds the preset time, and output means for outputting excess time information or information associated with excess time information when said excess time determining means determines that the time lag exceeds the preset time.

14. An apparatus according to claim 8, further comprising:

excess time determining means for comparing a preset time with each official total time indicated by the official total time information output from said official total information output means, and for determining whether the official total time exceeds the preset time, and output means for outputting excess time information or information associated with excess time information when said excess time determining means determines that the official total time exceeds the preset time.

15. A time measurement apparatus comprising:

identification information receiving means, respectively arranged at a plurality of points which a plurality of moving objects, each of which independently transmits moving object identification information, sequentially pass, for receiving pieces of moving object identification information respectively transmitted from the moving objects every time the moving objects pass through the respective points;

information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

movement start time point detecting means for detecting a movement start time point of the plurality of moving objects;

time lag measurement means for measuring times, as time lags, between reception time points at which the pieces of moving object identification information are received by said identification information receiving means, of said plurality of identification information means, which is located at a first point through which the respective moving objects pass, and the movement start time point detected by said movement start time point detecting means; and time lag information output means for outputting pieces of time lag information indicating the time lags measured by said time lag measurement means, and the pieces of moving object identification information corresponding to the pieces of time point lag information.

16. An apparatus according to claim 15, further comprising:

total time measurement means for measuring total times between the reception time points indicated by the pieces of reception time point information output from said information output means and the movement start time point, and official total information output means for outputting pieces of official total time information indicating official total times obtained by subtracting the pieces of time lag information measured by said time lag measurement means from the total times measured by said total time measurement means, and the pieces of moving object identification information corresponding to the pieces of official total time information.

17. An apparatus according to claim 15, further comprising:

arriving order determining means for determining arriving orders of the respective moving objects on the basis of the pieces of moving object identification information and time lag information output from said time lag information output means, and arriving order information output means for outputting pieces of arriving order information indicating the arriving orders determined by said arriving order determining means, and the pieces of moving object identification information corresponding to the pieces of arriving order information.

18. An apparatus according to claim 16, further comprising:

arriving order determining means for determining arriving orders of the respective moving objects on the basis of pieces of moving object identification information and official total time information output from said official total time information output means, and arriving order information output means for outputting pieces of arriving order information indicating the arriving orders determined by said arriving order determining means, and the pieces of moving object identification information corresponding to the pieces of arriving order information.

19. An apparatus according to claim 15, further comprising:

excess time determining means for comparing a preset time with each time lag indicated by the time lag information output from said time lag information output means, and for determining whether the time lag exceeds the preset time, and output means for outputting excess time information or information associated with excess time information when said excess time determining means determines that the time lag exceeds the preset time.

20. An apparatus according to claim 16, further comprising:

excess time determining means for comparing a preset time with each official total time indicated by the official total time information output from said official total information output means, and for determining whether the official total time exceeds the preset time, and output means for outputting excess time information or information associated with excess time information when said excess time determining means determines that the official total time exceeds the preset time.

21. A time measurement apparatus comprising:

identification information receiving means, respectively arranged at a plurality of points through which a plurality of moving objects, each of which independently transmits moving object identification information, sequentially pass, for receiving pieces of moving object identification information respectively transmitted from the moving objects every time the moving objects pass through the respective points;

information output means for, every time the pieces of moving object identification information are received by said identification information receiving means in a unit of moving objects sequentially outputting the received pieces of moving object identification information and pieces of reception time point information indicating time points at which the pieces of moving object identification information are received;

movement start time point detecting means for detecting a movement start time point of the plurality of moving objects;

total time measurement means for measuring total times between the reception time points indicated by the pieces of reception time point information output from said information output means and the movement start time point;

total time information output means for outputting pieces of total time information indicating the total times measured by said total time measurement means, and the pieces of moving object identification information corresponding to the pieces of total time information;

excess time determining means for comparing a preset time with each total time indicated by the total time information output from said total time information output means, and for determining whether the total time exceeds the preset time; and output means for outputting one of (a) excess time information and (b) information associated with excess time information when said excess time determining means determines that the total time exceeds the preset time.

22. A time measurement apparatus comprising:

identification information receiving means, respectively arranged at a plurality of points through which a plurality of moving objects, each of which independently transmits moving object identification information, sequentially pass, for receiving pieces of moving object identification information respectively transmitted from the moving objects every time the moving objects pass through the respective points;

information output means for, every time the pieces of moving object identification information are received by said identification information receiving means in a unit of moving objects, sequentially outputting the received pieces of moving object identification information add pieces of reception time point information indicating time points at which the pieces of moving object identification information are received;

split time measurement means for measuring split times between reception time points at which the pieces of moving object identification information are sequentially received, in units of moving objects, by adjacent identification information receiving means, of said plurality of identification information receiving means;

split time information output means for outputting pieces of split time information indicating the split times measured by said split time measurement means, and the pieces of moving object identification information corresponding to the pieces of split time information;

excess time determining means for comparing a preset time with each split time indicated by the split time information output from said split time information output means, and for determining whether the split time exceeds the preset time; and output means for outputting excess time information or information associated with excess time information when said excess time determining means determines that the split time exceeds the preset time.

23. A time measurement system comprising:

a plurality of moving objects for respectively independently transmitting pieces of moving object identification information;

identification information receiving means, respectively arranged at a plurality of points through which said plurality of moving objects sequentially pass, for receiving the pieces of moving object identification information respectively transmitted from said moving objects every time said moving objects pass through the respective points; and information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

and wherein:

said moving objects are mounted on a respective user's arm;

said moving objects comprise respective wristwatches, each wristwatch having a display for displaying a current time, and transmitting means for transmitting said moving object identification information; and said transmitting means is detachably attached to said respective wristwatches.

24. A system according to claim 23, further comprising:

movement start time point detecting means for detecting a movement start time point of the wristwatches, total time measurement means for measuring total times between the reception time points indicated by the pieces of reception time point information output from said information output means and the movement start time point, and total time information output means for outputting pieces of total time information indicating the total times measured by said total time measurement means, and the pieces of moving object identification information corresponding to the pieces of total time information.

25. A system according to claim 23, further comprising:

split time measurement means for measuring split times between reception time points at which the pieces of moving object identification information are sequentially received, in units of wristwatches, by adjacent identification information receiving means, of said plurality of identification information receiving means, and split time information output means for outputting the split times measured by said split time measurement means, and the pieces of moving object identification information corresponding to the pieces of split time information.

26. A system according to claim 23, further comprising:

movement start time point detecting means for detecting a movement start time point of the plurality of moving objects, time lag measurement means for measuring times, as time lags, between reception time points at which the pieces of moving object identification information are received, in units of moving objects, by identification information receiving means, of said plurality of identification information means, which is located at a first point through which the respective moving objects pass, and the movement start time point detected by said movement start time point detecting means, and time lag information output means for outputting pieces of time lag information indicating the time lags measured by said time lag measurement means, and the pieces of moving object identification information corresponding to the pieces of time lag information.

27. A system according to claim 26, further comprising:

total time measurement means for measuring total times between the reception time points indicated by the pieces of reception time point information output from said information output means and the movement start time point, and official total information output means for outputting pieces of official total time information indicating official total times obtained by subtracting the pieces of time lag information measured by said time lag measurement means from the total times measured by said total time measurement means, and the pieces of moving object identification information corresponding to the pieces of official total time information.

28. A system according to claim 24, further comprising:

excess time determining means for comparing a preset time with each total time indicated by the total time information output from said total information output means, and for determining whether the total time exceeds the preset time, and output means for outputting one of (a) excess time information and (b) information associated with excess time information when said excess time determining means determines that the total time exceeds the preset time.

29. A system according to claim 25, further comprising:

excess time determining means for comparing a preset time with each split time indicated by the split time information output from said split time information output means, and for determining whether the split time exceeds the preset time, and output means for outputting excess time information or information associated with excess time information when said excess time determining means determines that the split time exceeds the preset time.

30. A system according to claim 26, further comprising:

excess time determining means for comparing a preset time with each time lag indicated by the time lag information output from said time lag information output means, and for determining whether the time lag exceeds the preset time, and output means for outputting excess time information or information associated with excess time information when said excess time determining means determines that the time lag exceeds the preset time.

31. A system according to claim 27, further comprising:

excess time determining means for comparing a preset time with each official total time indicated by the official total time information output from said official total information output means, and for determining whether the official total time exceeds the preset time, and output means for outputting excess time information or information associated with excess time information when said excess time determining means determines that the official total time exceeds the preset time.

32. A system according to claim 23, further comprising:

passing order determining means for determining passing orders of the respective wristwatches on the basis of the pieces of moving object identification information and reception time point information output from said information output means, and arriving order information output means for outputting pieces of passing order information indicating the passing orders determined by said passing order information determining means, and the pieces of moving object identification information corresponding to the pieces of passing order information.

33. A system according to claim 24, further comprising:

arriving order determining means for determining arriving orders of the respective moving objects on the basis of the pieces of moving object identification information and total time information output from said total time information output means, and arriving order information output means for outputting pieces of arriving order information indicating the arriving orders determined by said arriving order determining means, and the pieces of moving object identification information corresponding to the pieces of arriving order information.

34. A system according to claim 25, further comprising:

arriving order determining means for determining arriving orders of the respective moving objects on the basis of the pieces of moving object identification information and split time information output from said split time information output means, and arriving order information output means for outputting pieces of arriving order information indicating the arriving orders determined by said arriving order determining means, and the pieces of moving object identification information corresponding to the pieces of arriving order information.

35. A time measurement system comprising:

a plurality of moving objects for respectively independently transmitting pieces of moving object identification information;

identification information receiving means, respectively arranged at a plurality of points through which said plurality of moving objects sequentially pass, for receiving the pieces of moving object identification information respectively transmitted from said moving objects every time said moving objects pass through the respective points;

information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

movement start time point detecting means for detecting a movement start time point of the plurality of moving objects;

time lag measurement means for measuring times, as time lags, between reception time points at which the pieces of moving object identification information are received, in units of moving objects, by identification information receiving means, of said plurality of identification information means, which is located at a first point through which the respective moving objects pass, and the movement start time point detected by said movement start time point detecting means; and time lag information output means for outputting pieces of time lag information indicating the time lags measured by said time lag measurement means, and the pieces of moving object identification information corresponding to the pieces of time lag information.

36. A system according to claim 35, further comprising:

total time measurement means for measuring total times between the reception time points indicated by the pieces of reception time point information output from said information output means and the movement start time point, and official total information output means for outputting pieces of official total time information indicating official total times obtained by subtracting the pieces of time lag information measured by said time lag measurement means from the total times measured by said total time measurement means, and the pieces of moving object identification information corresponding to the pieces of official total time information.

37. A system according to claim 35, further comprising:

arriving order determining means for determining arriving orders of the respective moving objects on the basis of the pieces of moving object identification information and time lag information output from said time lag information output means, and arriving order information output means for outputting pieces of arriving order information indicating the arriving orders determined by said arriving order determining means, and the pieces of moving object identification information corresponding to the pieces of arriving order information.

38. A system according to claim 36, further comprising:

arriving order determining means for determining arriving orders of the respective moving objects on the basis of pieces of moving object identification information and official total time information output from said official total time information output means, and arriving order information output means for outputting pieces of arriving order information indicating the arriving orders determined by said arriving order determining means, and the pieces of moving object identification information corresponding to the pieces of arriving order information.

39. A system according to claim 35, further comprising:

excess time determining means for comparing a preset time with each time lag indicated by the time lag information output from said time lag information output means, and for determining whether the time lag exceeds the preset time, and output means for outputting excess time information or information associated with excess time information when said excess time determining means determines that the time lag exceeds the preset time.

40. A system according to claim 36, further comprising:

excess time determining means for comparing a preset time with each official total time indicated by the official total time information output from said official total information output means, and for determining whether the official total time exceeds the preset time, and output means for outputting excess time information or information associated with excess time information when said excess time determining means determines that the official total time exceeds the preset time.

41. A time measurement system comprising:

a plurality of moving objects for respectively independently transmitting pieces of moving object identification information;

identification information receiving means, respectively arranged at a plurality of points through which said plurality of moving objects sequentially pass, for receiving the pieces of moving object identification information respectively transmitted from said moving objects every time said moving objects pass through the respective points;

information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

movement start time point detecting means for detecting a movement start time point of the plurality of moving objects;

total time measurement means for measuring total times between the reception time points indicated by the pieces of reception time point information output from said information output means and the movement start time point;

total time information output means for outputting pieces of total time information indicating the total times measured by said total time measurement means, and the pieces of moving object identification information corresponding to the pieces of total time information;

excess time determining means for comparing a preset time with each total time indicated by the total time information output from said total information output means, and for determining whether the total time exceeds the preset time; and output means for outputting one of (a) excess time information and (b) information associated with excess time information when said excess time determining means determines that the total time exceeds the preset time.

42. A time measurement system comprising:

plurality of moving objects for respectively independently transmitting pieces of moving object identification information;

identification information receiving means, respectively arranged at a plurality of points through which said plurality of moving objects sequentially pass, for receiving the pieces of moving object identification information respectively transmitted from said moving objects every time said moving objects pass through the respective points;

information output means for, every time the pieces of moving object identification information are received by said identification information receiving means in a unit of moving objects, sequentially outputting the received pieces of moving object identification information and pieces of reception time point information indicating time points at which the pieces of moving object identification information are received;

split time measurement means for measuring split times between reception time points at which the pieces of moving object identification information are sequentially received, in units of moving objects, by adjacent identification information receiving means, of said plurality of identification information receiving means;

split time information output means for outputting the split times measured by said split time measurement means, and the pieces of moving object identification information corresponding to the pieces of split time information;

excess time determining means for comparing a preset time with each split time indicated by the split time information output from said split time information output means, and for determining whether the split time exceeds the preset time; and output means for outputting excess time information or information associated with excess time information when said excess time determining means determines that the split time exceeds the preset time.

43. A reception apparatus for receiving pieces of moving object identification information and movement-associated information transmitted from a plurality of external transmission units for externally transmitting pieces of moving object identification information and movement-associated information at positions where said external transmission units are arranged, said reception apparatus comprising wristwatches mounted on respective user's arms, said wristwatches each including:

a display for displaying at least a current time;

reception means for receiving moving object identification information and movement-associated information transmitted from each external transmission unit;

matching determination means for determining whether the moving object identification information received by said reception means matches with self-identification information; and information display control means for performing a control operation to display the movement-associated information received by said reception means on said display, when said matching determination means determines that the received moving object identification information matches with the self-identification information.

44. A mobile electronic device comprising:

wristwatches mounted on arms of respective moving users; and a detachable member detachably mounted on respective ones of said wristwatches, said detachable member including reception means for receiving a transmission signal transmitted externally; and said wristwatches each including information display means for displaying reception time point information in response to a transmission signal received by said reception means the reception time point information indicating a reception time point at which the transmission signal is received.

45. A mobile electronic device comprising:

wristwatches mounted on arms of respective moving users; and a detachable member detachably mounted on respective ones of said wristwatches, said detachable member including reception means for receiving moving object identification information transmitted externally;

said wristwatches each including:

(1) matching determination means for determining whether the moving object identification information received by said reception means of a detachable member matches with self-identification information, and (2) information display means for displaying reception time point information indicating a reception time point at which the moving object identification information is received, when said matching determination means determines that the received moving object identification information matches with the self-identification information.

46. A mobile electronic device comprising:

wristwatches mounted on arms of respective moving users; and a detachable member detachably mounted on respective ones of said wristwatches, said detachable member including reception means for receiving externally transmitted moving object identification information and movement-associated information associated with a moving state of said wristwatches;

said wristwatches each including:

(1) matching determination means for determining whether the moving object identification information received by said reception means of a detachable member matches with self-identification information, and (2) information display means for displaying reception time point information indicating a reception time point at which the moving object identification information is received, and the movement-associated information, when said matching determination means determines that the received moving object identification information matches with the self-identification information.

* * * * *